US008316528B2

(12) United States Patent
Pulnikov

(10) Patent No.: US 8,316,528 B2
(45) Date of Patent: Nov. 27, 2012

(54) METHOD FOR MAKING ELECTRICAL WINDINGS FOR TRANSFORMERS AND ELECTRICAL APPARATUS

(75) Inventor: Sergey Pulnikov, Villingen-Schwenningen (DE)

(73) Assignee: Sergey Pulnikov, Villingen-Schwenningen (DE)

( * ) Notice: Subject to any disclaimer, the term of this patent is extended or adjusted under 35 U.S.C. 154(b) by 0 days.

(21) Appl. No.: 12/796,030

(22) Filed: Jun. 8, 2010

(65) Prior Publication Data

US 2011/0163833 A1 Jul. 7, 2011

Related U.S. Application Data

(63) Continuation of application No. 12/144,855, filed on Jun. 24, 2008, now abandoned.

(51) Int. Cl.
*H01F 7/06* (2006.01)

(52) U.S. Cl. ..... 29/605; 29/602.1; 29/606; 242/437.3; 242/437.4; 242/443; 242/445.1; 336/212; 336/234

(58) Field of Classification Search ..... 29/602.1, 29/605, 606; 336/212, 234; 242/437.3, 437.4, 242/443, 445.1
See application file for complete search history.

(56) References Cited

U.S. PATENT DOCUMENTS 3,323,200 A 6/1967 McKeon et al.
3,811,045 A 5/1974 Turner et al.
4,053,975 A 10/1977 Olbrich et al.
5,321,965 A * 6/1994 Baird ..... 72/142
5,715,591 A * 2/1998 Albrecht et al. ..... 29/605
5,867,891 A * 2/1999 Lampe et al. ..... 29/605
5,903,207 A * 5/1999 Lampe et al. ..... 336/192
6,337,526 B1 * 1/2002 Lin et al. ..... 310/90.5

OTHER PUBLICATIONS

Sanjay K. Mazumdar, "Composites Manufacturing. Materials, Product and Process Engineering", 2002, published by CRC Press LLC, pp. 139, 141, 143, 144, 145, 148, 149. USA.
Dry-Type Distribution Transformer RESIBLOCK, 2003, published by ABB, www05.abb.com.
Cast-resin Dry-Type Transformer GEAFOL, published by SIEMENS, www.siemens.hu.

* cited by examiner

*Primary Examiner* — Paul D Kim

(57) ABSTRACT

A method of manufacturing electrical windings for transformers and electrical apparatus is disclosed. This method comprises the following steps: manufacturing a metal mandrel defining the internal shape of the winding; installation of an internal insulation and support; installation of side rings; pouring impregnation compound on horizontally turning mandrel for obtaining a thin layer on the operational area of the mandrel and side surface of the side rings; optionally curing this layer; fixation of the first end wire using one of side rings; manufacturing winding with simultaneous pouring of compound onto the mandrel; possibly introducing intermediate insulation and/or reinforcing layers of preimpregnated reinforced plastics; optionally inserting premade sleeves around section of the winding; fixation of the second end wire using one of side rings; possibly introducing external insulation or reinforcing layers of preimpregnated reinforced plastics; possibly manufacturing secondary windings on top of the wound winding; curing the winding; extraction of the cured winding or a set of cured windings from the mandrel.

33 Claims, 24 Drawing Sheets

METHOD FOR MAKING ELECTRICAL WINDINGS FOR TRANSFORMERS AND ELECTRICAL APPARATUS

CROSS-REFERENCE TO RELATED APPLICATIONS

This application is continuation of application Ser. No. 12/144,855 filed Jun. 24, 2008 now abandoned.

TECHNICAL FIELD

This invention is related to the production of electrical windings for electrical apparatus and transformers. This invention is also related to winding structures obtained by the said method.

BACKGROUND INFORMATION

This invention relates to a method of manufacturing electrical windings for electrical apparatus and transformers. This method comprises the following steps: manufacturing a metal mandrel defining the internal shape of the winding; installation of an internal insulation and support; installation of side rings; pouring impregnation compound on horizontally turning mandrel for obtaining a thin layer on the operational area of the mandrel and side surface of the side rings; optionally curing this layer; fixation of the first end wire using one of side rings; manufacturing winding with simultaneous pouring of compound onto the mandrel; possibly introducing intermediate insulation and/or reinforcing layers of impregnated fibers; optionally inserting previously manufactured sleeves around sections of the winding; fixation of the second end wire using one of side rings; possibly introducing external insulation or reinforcing layers of impregnated fibers; possibly manufacturing secondary windings on top of the wound winding; curing the winding; extraction of the cured winding or a set of cured windings from the mandrel. The invention also relates to winding structures obtained by this method.

DISCUSSION OF THE PRIOR ART

Conventional technique for small windings implies the use of plastic holders fitting a magnetic core on which an electrical winding is supposed to be mounted. Holders provide rigidity to the winding. For production reasons and for containing forces emerging during winding process, holders usually have thickness that considerably exceeds electrical requirements. Oversizing these holders affects the size of the windings as well as the size of the whole device. A manufacturing process based on previously manufactured holders is described in U.S. Pat. No. 3,811,045.

Since magnetic cores are often performed laminated, the winding holders largely have a rectangular cross-section. Copper wire cannot conform to abrupt variations in the winding direction. This leads to a poor thermal contact between the winding and the holder. In order to avoid overheating and insulation failure, the current density in the winding has to be reduced accordingly, which further increases space occupied by the winding.

This problem can be solved by making self-supporting coils. One of manufacturing processes for self-supporting coils is presented in U.S. Pat. No. 3,323,200. This method is based on the use of a thermally shrinkable mandrel. There are very few materials which exhibit negative thermal expansion. Besides, polymer compounds used for impregnation of electric windings shrink during curing. So for a majority of practical cases such an approach seems unsuitable.

In U.S. Pat. No. 4,053,975 a more elaborated approach is presented, which is based on a mandrel consisting of a number of segments. A disadvantage of such an approach is in the need of assembly and disassembly of a fairly complex mandrel, which would impede automation of such a process.

Windings of Cast-resin dry-type transformers GEAFOL of Siemens are filled with a mixture of epoxy resin and quartz powder. Most epoxies have larger thermal expansion compared to material of the winding. Through introduction of quartz powder that has low thermal expansion a good match can be achieved between thermal expansion of the compound and thermal expansion of the material of the winding. This reduces thermal stresses on the insulation at operation loads. Introduction of quartz powder improves thermal conductivity and reduces thermal expansion. However it also increases viscosity of the compound, which increases the chance for porosity. Besides, the proposed insulating material does not have the highest electrical strength, therefore such transformers are not applied for voltages above 35 kV. Introduction of quartz powder does not lead to superior mechanical properties of insulation as could be required for short-circuit modes. Practice of exploitation of such dry transformers with cast windings shows that due to mechanical forces at short circuits and vibrations cracks can emerge in cast insulation.

Another well known technology, presented by ABB, is called RESIBLOC. This is a two-step process. First the copper winding is manufactured and then the glass-fiber laminate is manufactured on top of the copper winding. This process improves mechanical rigidity of the winding, and the glass-fiber composite is used for reinforcement of the copper winding. Practice of exploitation of RESIBLOC transformers shows that there are no cracks in insulation. In the transformers made according to the RESIBLOC technology, there is no layer insulation, therefore the RESIBLOC technology is not applied for voltages above 40 kV. Technology presented in the proposed invention allows benefiting from good electrical properties of glass-fiber composites. Through introduction of wet filament winding process into conventional copper winding technology a better coupling between reinforcement and the copper winding as well as higher insulation strength can be achieved. Technology presented in the proposed invention also offers to improvement of side and layer insulation.

With regard to conventional technology, in large windings there is a problem of achieving sufficient mechanical rigidity and cooling. This forces transformer producers to use expensive helical and continuous disk type of windings instead of more technological layer windings. The method proposed in this invention provides possibilities for reducing thermal gradient inside the winding and maintaining good mechanical properties. A method of winding and a structure of such a winding are described in the second embodiment of the presented invention.

This invention utilizes basic principles of wet filament winding described in "Composites Manufacturing. Materials, Product and Process Engineering" by Sanjay K. Mazumdar, published in 2002 by CRC Press LLC. Some general aspects of this technology are also described in U.S. Pat. No. 5,084,219 and U.S. Pat. No. 5,639,337.

SUMMARY OF INVENTION

One of the primary objects of the present invention is to provide a method of manufacturing a self-supporting electrical winding for power devices.

Another object of the present invention is to utilize a simple construction of the mandrel defining the internal shape of the winding.

A further object of the present invention is to provide an internal and external insulation and reinforcement for the winding.

A further object of the present invention is to allow a simple use of thermally conductive impregnating compounds.

A further object of invention is to provide a way of improving insulation between wires and neighboring layers.

A further object of invention is to provide insulation in accordance with local voltage gradient thereby improving efficiency of insulation between wires and neighboring layers.

A further object of the present invention is to provide a cost efficient method of winding assembly suitable for large series production.

A further object of the present invention is to provide a rigid structure for cylindrical windings suitable for application in power transformers.

A further object of the present invention is to provide improved cooling for cylindrical windings suitable for application in power transformers.

These objects are achieved as follows. A metal mandrel is manufactured defining the internal shape of the winding. Then side rings and possibly a composite previously manufactured sleeve or a braided sleeve defining internal support are installed on the said mandrel. After that a thermally conducting compound containing large content of thermally conducting insulating powder is poured on the horizontally turning mandrel for obtaining a thin layer on the operational area of the winding and side surface of the side rings. This layer can be optionally cured. Then the first end wire is fixed using one of side rings and the winding is manufactured with simultaneous pouring of said thermally conducting compound onto the mandrel. Intermediate insulation and reinforcing layers of impregnated reinforced plastics can be optionally introduced. If necessary, additional compound is added on top of the turning winding. The proposed manufacturing method also foresees a possibility of inserting previously manufactured composite sleeves or braided sleeves. After the winding is completed, the second end wire is fixed using one of side rings. If necessary, secondary windings can be wound on top of the manufactured winding in a similar manner. After that the winding is cured and removed from the mandrel.

As described further the presented manufacturing method reduces a number of conventional manufacturing steps. Besides, this method allows the use of advanced materials and automation of the process.

The invention also relates to winding structures obtained by this method.

BRIEF DESCRIPTION OF THE DRAWINGS

The embodiment will be described with reference to the accompanying drawings, in which.

DETAILED DESCRIPTION

The proposed invention is related to the wide range of windings suited for low power transformers and inductors, medium power devices as well as for high voltage and high power devices.

There are specific requirements for each power range and each voltage range. In order to meet these requirements each step in the technology presented further has to be adopted accordingly.

Figure 1:
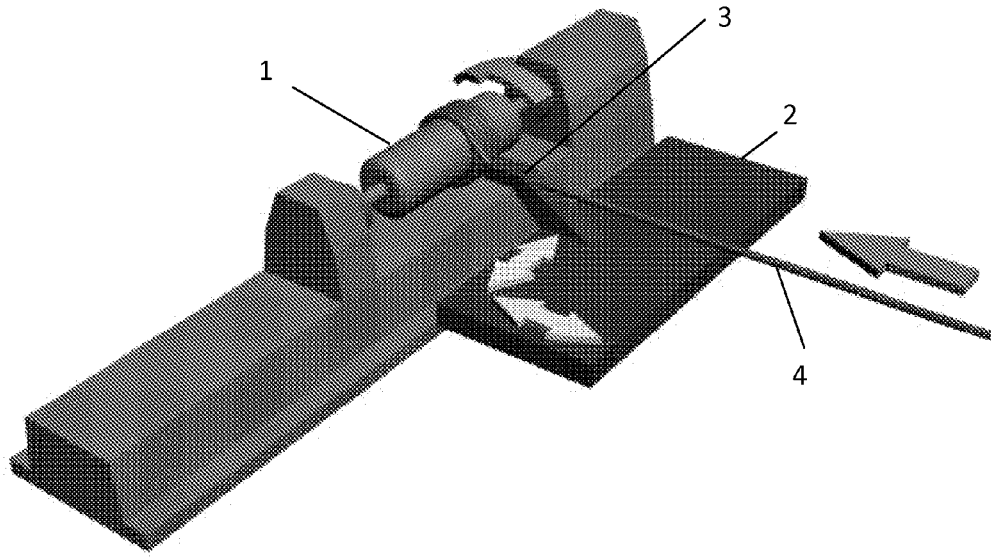
FIG. 1 represents the winding process and basic elements of a winding machine.

Some basics of the winding process are illustrated in FIG. 1. The mandrel 1 defining the internal shape of the winding is fixed in a turning machine. Next to the turning machine there is a moving table 2 that can execute translational movements along the mandrel and also towards the mandrel and away from the mandrel as indicated by arrows. There is a winding eye 3 installed on the moving table 2 that guides winding material 4. The winding eye can contain a guiding profile corresponding to the profile of the winding material. This guiding profile can be covered with a low friction material like Teflon. The winding eye can also contain a set of rolls in order to further reduce friction. In order to have good quality of the winding, movements of the moving table 2 must correspond to angular movements of the mandrel 1. If the winding material has a fabric-like structure that has to be impregnated it can either pass an impregnation bath with impregnating compound or it can also be impregnated directly on the mandrel. In order to assure good impregnation quality and provide compact winding, the winding material can pass through a pretension unit. Since both impregnation baths and pretension facilities are freely available on the market, these elements are not shown in FIG. 1.

Figure 2:
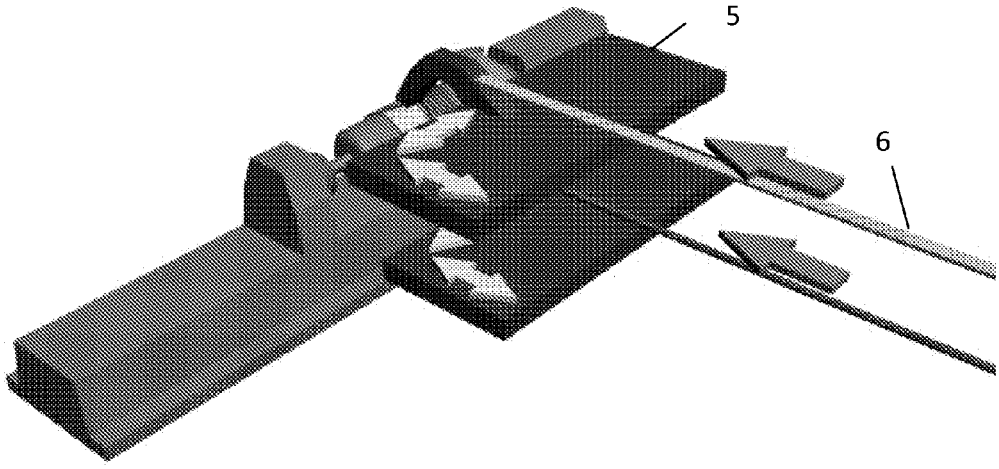
FIG. 2 represents a winding machine with two moving tables.

The winding facility can have a number of moving tables as demonstrated in FIG. 2. The second moving table 5 can provide winding material 6 that is different from the winding material 4 provided by the first moving table 2. The second moving table can move independently from the first table. Each table can have a number of winding eyes installed. The distance between winding eyes can be reset for each new winding.

Figure 3:
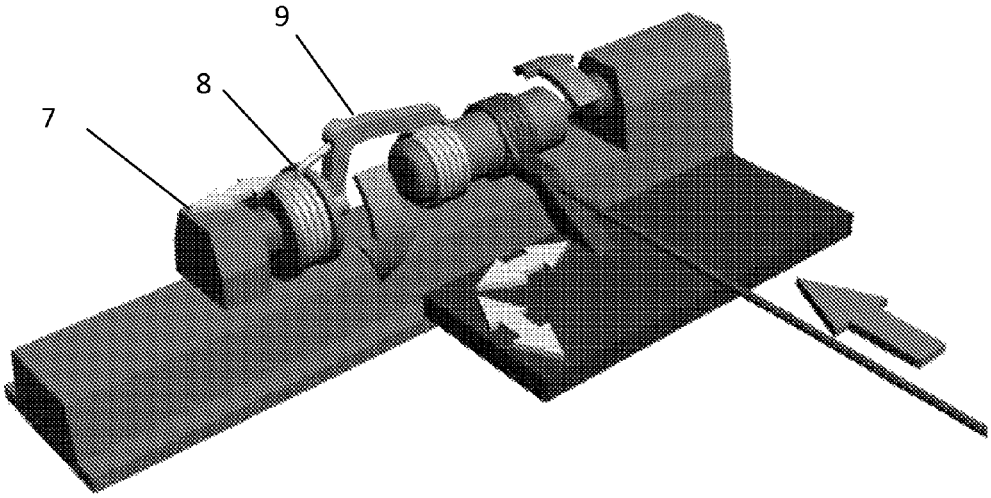
FIG. 3 shows a modified winding machine with a second turning spindle.

For complex winding patterns independent angular displacements might be required. These displacements require an additional spindle 7 as shown in FIG. 3. A bobbin with winding material 8 can be optionally located between the spindle and a corresponding winding eye 9. Technically it is quite easy to accomplish. So with such a winding machine two independent winding patterns can be manufactured simultaneously.

Previously Manufactured Sleeves

As will be clarified later, for some winding types two different winding patterns could be required. For that purpose either this special winding machine (FIG. 3) would be used, or more common variants (FIG. 1 or FIG. 2), but with a number of previously manufactured sleeves. By previously manufactured sleeves we would imply a preliminary wound and at least preliminary cured composite bandage manufactured on a mandrel which outer shape corresponds to the outer shape of the winding at the specified step of the winding. Preliminary curing is an intermediate stage in the curing process of a polymer. As curing goes on, the stiffness of such a bandage would gradually increase. When sufficient stiffness is achieved, the bandage can be extracted from its mandrel. Incompletely cured bandage would provide a good bonding with other elements of an electrical winding. As an option, if maximum rigidity is expected, the bandage can also be completely cured. Such a previously manufactured sleeve can be installed at the side of the mandrel where electrical winding is being manufactured in order to be installed on the electrical winding at the appropriate stage of the winding process.

As an alternative to previously manufactured sleeves, braided sleeves could also be used. Braided sleeves are available on the market already for some years and allow a great deal of extendibility. Braided sleeves are made with a certain axial angle between the rovings. This angle can either be decreased by pulling the sleeve in the axial direction or decreased by extending the sleeve in the radial direction, because rovings can move in braided sleeves. So the inner diameter can increase 2-3 times compared to the original value. This makes such sleeves easily adjustable to arbitrary winding shape. The sleeves can be handled manually. Impregnation of these braided sleeves can be carried out either directly on the winding, or it can also be performed prior to installation of these sleeves.

Mandrel

Figure 4:
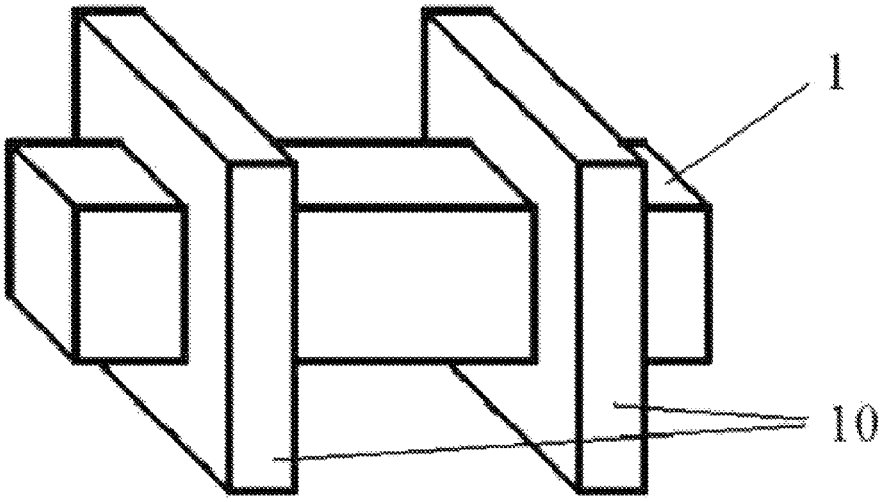
FIG. 4 represents a square mandrel and side rings.
Figure 5:
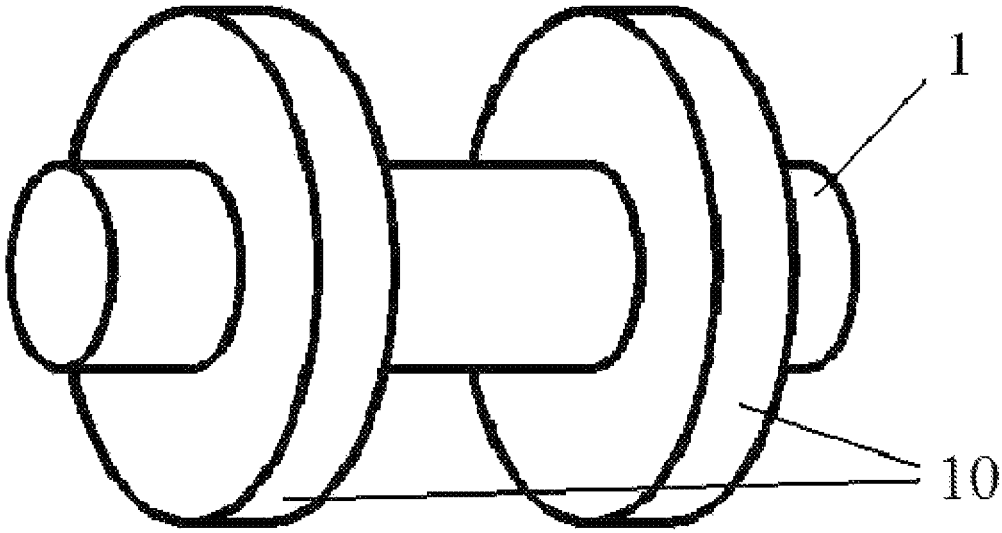
FIG. 5 represents a circular mandrel and side rings.

Referring to the drawings, FIG. 4 and FIG. 5 illustrate a construction of a mandrel 1 whereupon the winding is to be wound. The mandrel defines the internal shape of the winding. In most cases the shape of the mandrel should correspond to the shape of the magnetic core. The mandrel can have a slight taper in the direction of extraction of the winding. Mandrel can have chrome plating for protection against scratching. Some release agent should be applied on the mandrel in order to facilitate extraction of the mandrel.

Figure 6:
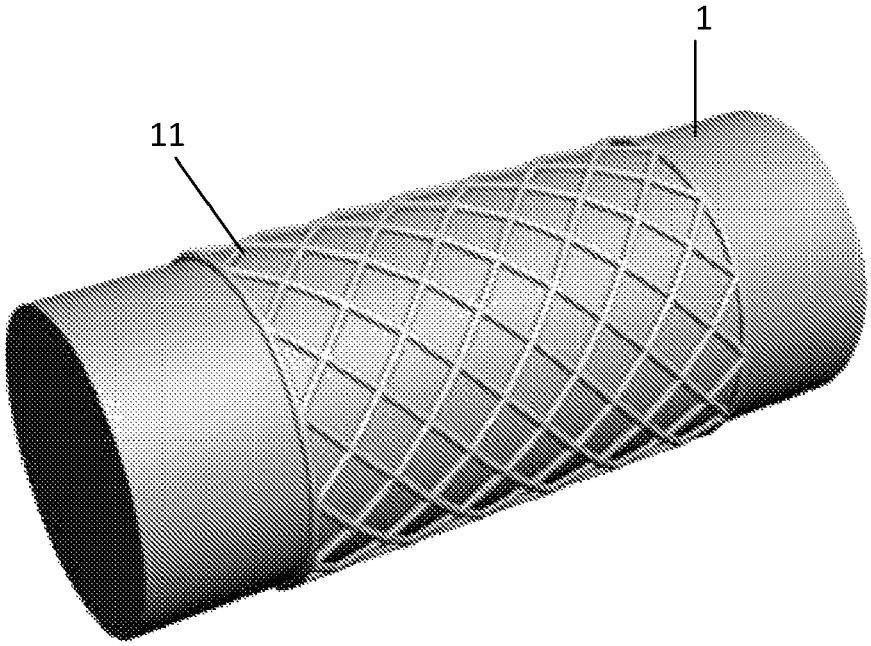
FIG. 6 represents an internal previously manufactured bandage installed on the mandrel.

Preferable materials for the mandrel are steel or aluminum. In some occasions if extra rigidity is needed for the winding, which is often the case for large power transformers, the winding can be performed on a previously manufactured composite bandage (cylinder) (pipe). Glass fiber is a preferable reinforcing material for such composite due to its good insulation properties. However other suitable fiber materials can also be applied. Such a bandage can be manufactured on the said mandrel using wet filament winding technology. In some cases this internal bandage can be directly wound on the mandrel with impregnated and optionally procured fiber rovings. The whole winding can then share the same curing cycle. The composite bandage 11 can either be a solid tube or have radial openings as shown in FIG. 6. The thickness of this tube is in the range from 10 μm to 100 mm. Radial openings would allow better thermal contact between the winding and the magnetic core. Radial openings would also facilitate flow of cooling liquid.

Figure 7:
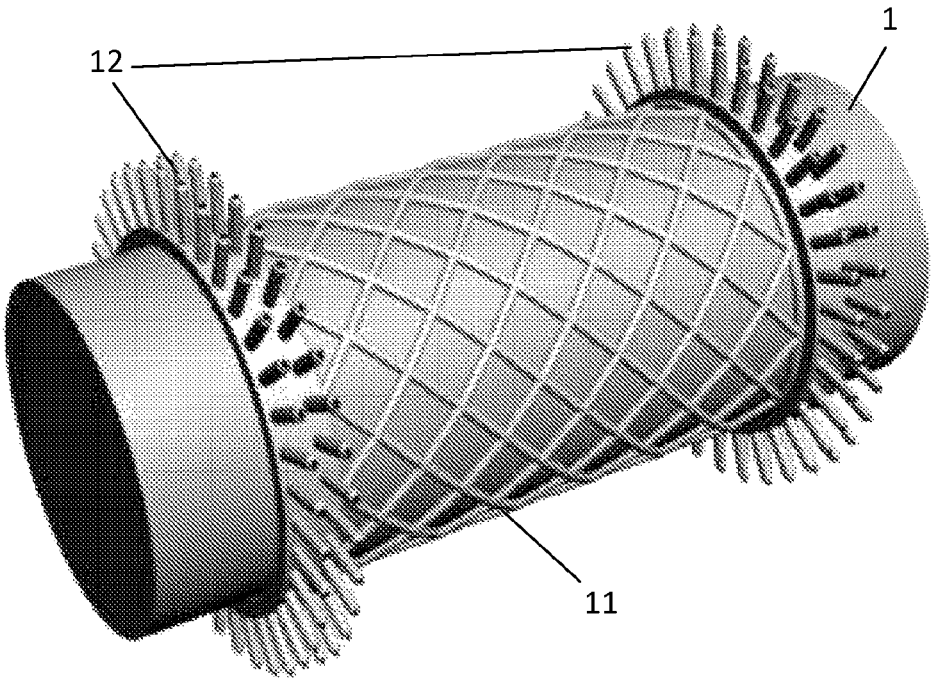
FIG. 7 represents an internal previously manufactured bandage and bandages with pins installed on the mandrel.

In large windings extra axial strength might be required because of possible operational stresses and in order to facilitate extraction of the winding from the mandrel. As will be shown further, this axial strength can be achieved by introducing an axial layer. Axial layer usually requires turning pins. These pins can be introduced by wrapping around the mandrel a pair of ribbons with pins 12 as presented on FIG. 7.

Figure 8:
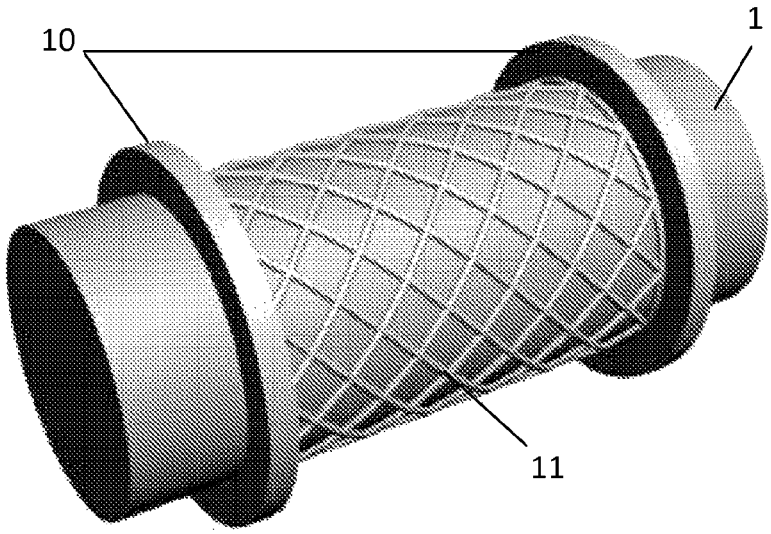
FIG. 8 represents an internal previously manufactured bandage and side rings installed on the mandrel.

After that side rings 10 are installed on the mandrel defining the axial length of the winding to be wound as shown in FIG. 4, FIG. 5 and FIG. 8. Side rings can either be of a metal or of composite material. In the latter case the side rings can be cut out of a composite pipe manufactured on the said mandrel. Thereby a correspondence of internal dimensions of the side rings and external dimensions of the mandrel can be achieved. This is especially important if the winding has to be wound on a square or rectangular mandrel like the one shown in FIG. 4. Besides, as composite materials are known to be conformable, mechanical damage of the mandrel during extraction of the winding would be reduced to minimum. If the mandrel has a taper, the side rings should be cut from corresponding parts of said composite tube.

Preparation of Thermally Conducting Compound

Thermally conducting compound is to be used in air-cooled windings. This compound is obtained by mixing a polymer or even a varnish with a powder or a mixture of different phases of the same powder or a mixture of different powders. Examples of suitable powders are quartz, sand, ceramics (like alumina, boron nitride, aluminum nitride) and others. The choice of powder can be affected by its thermal, mechanical and insulation properties. Mixture of powder and polymer has higher viscosity compared to that of the pure polymer. Compounds with comparatively high thermal conductivity look more like pastes then liquids. Therefore they are not suitable for direct impregnation of wound windings through filling or casting.

However addition of powder also reduces thermal expansion and decreases curing shrinkage of the compound compared to the pure polymer. In the proposed technique high viscosity is turned into advantage.

With increased viscosity of the compound the amount of trapped air also increases. This deteriorates insulation properties of insulation. In order to reduce the amount of trapped air, the compound can be vacuumed, by placing it in a vacuum chamber.

Incompletely Cured Internal Layer

The next manufacturing step is necessary for small windings wound with round metal wire. As the wire is wound with pretension it can penetrate into the lower layer by shifting the wires of the lower layer. This effect is known and requires fixation of the first layer of metal wire. Conventionally fixation is implemented by introducing small round slots which would help preventing displacement of metal wires. This increases the complexity of the holder.

Figure 9:
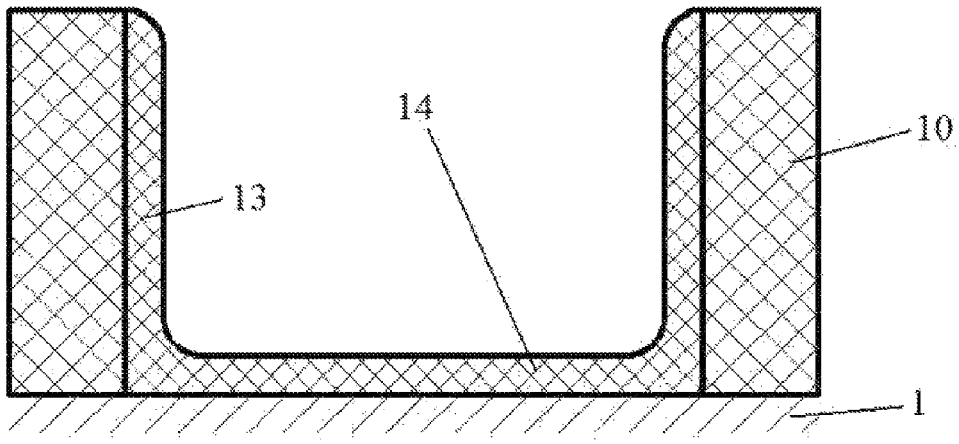
FIG. 9 represents a cross-section of a mandrel, side rings and an internal insulating layer.

In the presented technique fixation of the first layer is implemented by introducing a half-cured internal layer. A layer of thermally conducting compound 14 is poured on the horizontally rotating mandrel and corresponding sides of the side rings as shown in FIG. 9. Part of the compound 13 situated on the side ring would provide a side insulation of such a winding. Due to high viscosity of the compound, it would be easy to keep it on the rotating mandrel. Viscous material has a difficulty in penetrating into small gaps. In this case this is a great advantage, as compound would not penetrate into the gap between the side rings and the mandrel. This will facilitate further extraction of the winding.

Skilled in the art can easily determine an optimum turning speed for given geometry of the mandrel and viscosity of the compound in order to achieve a uniform layer of internal insulation. After that an incomplete curing is implemented. The mandrel should rotate during curing.

Incomplete curing means that the internal layer retains certain softness and tack. However the internal layer should also be hard enough in order to avoid penetration of the wire through this layer. Depending on the type of the wire chosen for the winding and pretension used during winding skilled in the art can choose a suitable level of curing.

Figure 10:
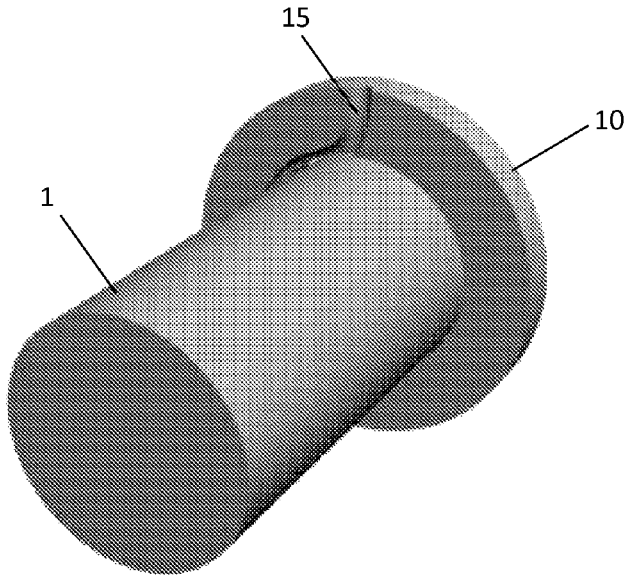
FIG. 10 represents a slot in a side ring for fixation of the end wire.
Figure 11:
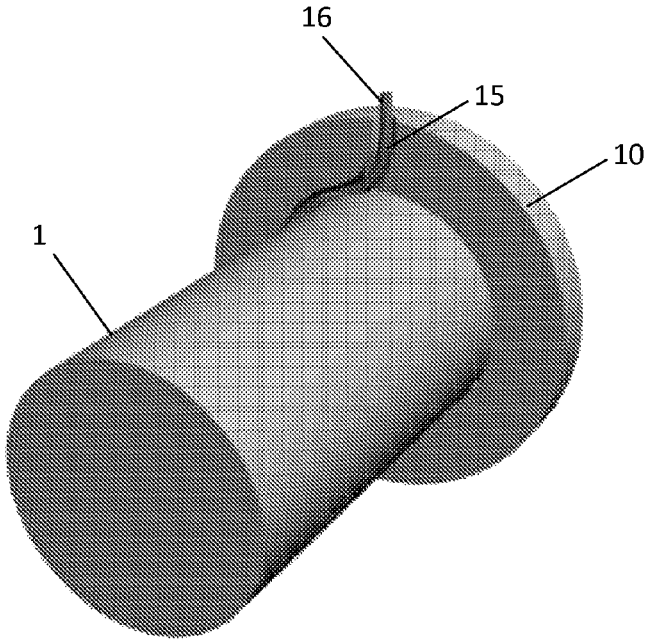
FIG. 11 represents a slot in a side ring for fixation of the end wire and the end wire in it.

Incompletely cured internal layer is used for securing the end wire. It is suggested in the presented technique to utilize a corresponding slot 15 in the side ring for that purpose. A possible configuration of such a slot is shown in FIG. 10. In FIG. 11 the end wire 16 is shown being pressed into the said slot. For the sake of clarity the internal incompletely cured layer is not shown in this figure. Since the internal layer retains softness and tack, pressing the end wire into it is a completely feasible operation. In order to strengthen insulation of the end wire a flexible impregnated braided glass-fiber sleeve can be slid over it.

Liquid Internal Layer

In case of winding with rectangular metal wire fixation of the first layer of wire is not such a problem, so incomplete curing can be avoided. The internal glass fiber layer 11 shown in FIG. 6 will provide a distance between the first layer of wire and the mandrel. Thermally conducting compound can be poured onto the mandrel and fill the openings in the internal layer.

The end wire can be fixed using a slot in the side ring. Alternatively the end wire can be secured using a ribbon with pins.

Winding the First Layer of Metal Wire

As was mentioned earlier, in case of small windings wound with round wire it is important that the first layer of metal wire is wound properly and displacement of the wire is avoided.

Figure 12:
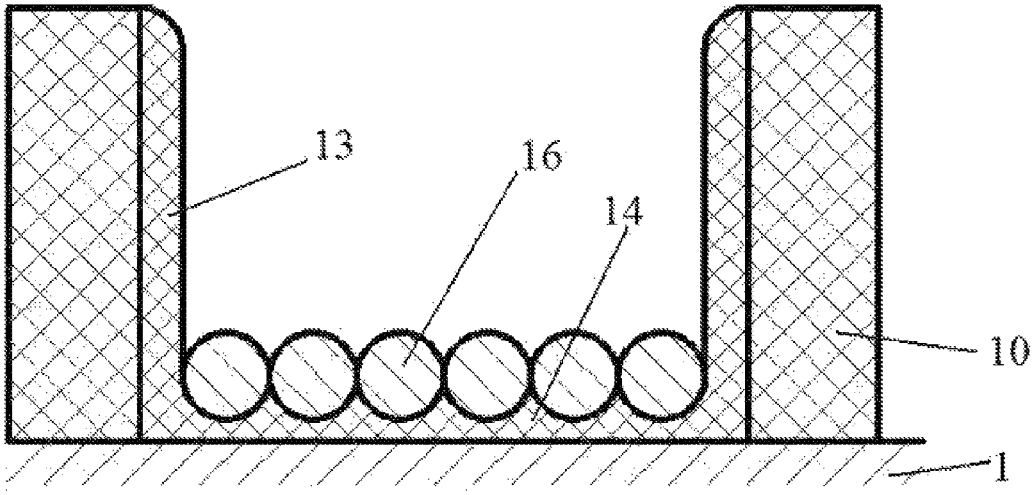
FIG. 12 represents a cross-section of the mandrel, side rings, the internal insulating layer and the first layer of the metal wires wound on said internal insulating layer.
Figure 13:
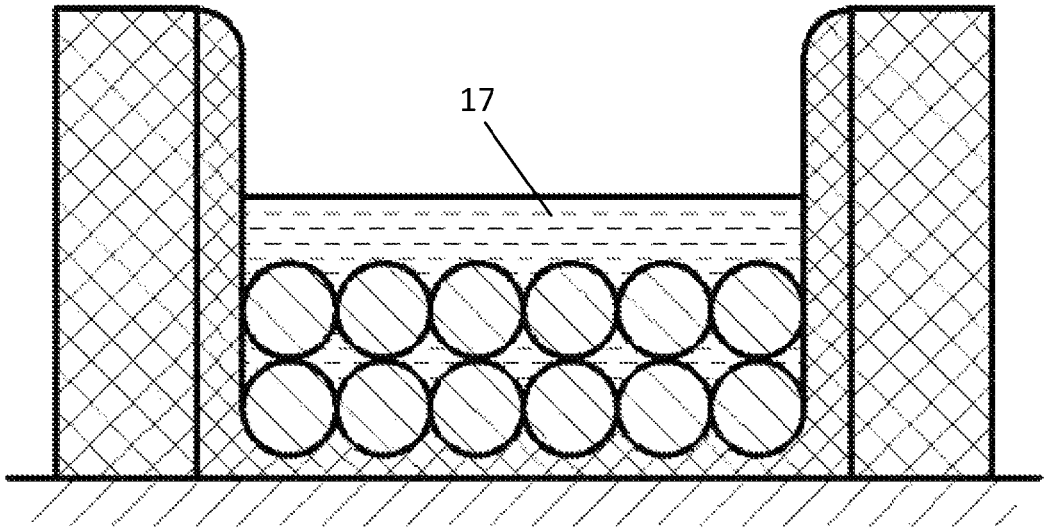
FIG. 13 represents a cross-section of the mandrel, side rings, the internal insulating layer, the first two layers of metal wires and impregnating compound poured onto metal wires.

Thermally conducting compound or other liquid or melted insulation material 17 can be poured as the first layer of metal wire is being wound. Small windings usually do not operate at high voltage. This process is illustrated in FIG. 12 and FIG. 13. If neither extra insulation nor mechanical reinforcement is needed, winding subsequent layers is very much the same as winding the first layer.

In case of rectangular or square wire a thick layer of thermally conducting compound should be present on top of the mandrel before the winding process is started. The best solution would be to make a sufficiently thick liquid internal layer. During the winding process compound would have been pushed upwards in the radial direction and in the direction of the winding. As the winding proceeds, additional amount of compound can be put on top of the wound layers.

Introducing Insulation Layers and Reinforcement into the Winding

Turning of the mandrel can also be utilized for introducing interlayer insulation, insulation at the sides of the winding and for introducing reinforcement into the winding. Insulation at the sides of the winding is particularly important in windings operating at high voltage.

Thermally conducting compound is unsuitable for impregnation of insulation tape or impregnation of glass fiber roving. Therefore an insulation tape and reinforcement have to be impregnated before reaching the mandrel. Wet filament winding technique offers a number of solutions for accomplishing this task.

It is better to utilize the same polymer both in the mentioned thermally conducting compound and for impregnation of insulation tapes and glass fiber roving in order to share the same curing cycle and the same operational thermal limits.

Figure 14:
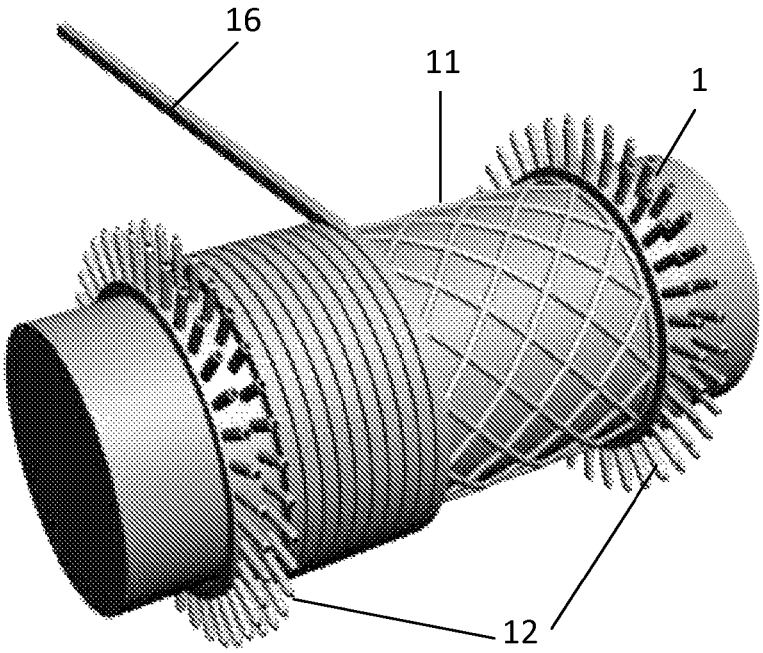
FIG. 14 represents the mandrel, previously manufactured internal bandage, side bandages with pins and the first layer of metal wire being wound.

In FIG. 14 winding with metal wire 16 is shown. The wire is wound with pretension ranging from 0.01 MPa to 1500 MPa depending on the material of the wire and expected operational stresses in the winding. The insulation tape comes from a separate feeding system having separate pretension and impregnation systems, because insulation tape might require a different level of pretension.

Figure 15:
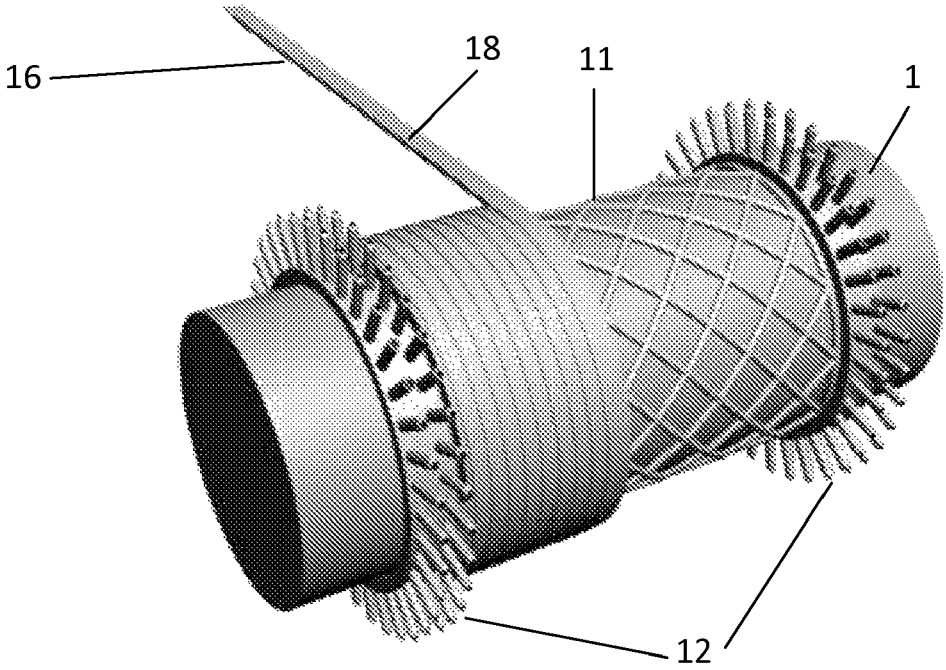
FIG. 15 represents the mandrel, previously manufactured internal bandage, side bandages with pins, the first layer of metal wire and a layer of impregnated insulation tape being wound on top of the metal wire.

Insulation tape 18 can be wound parallel with the metal wire as shown in FIG. 15. By varying the width of the insulation tape different levels of overlapping can be achieved. Larger overlapping defines larger effective thickness of the insulation layer.

Figure 16:
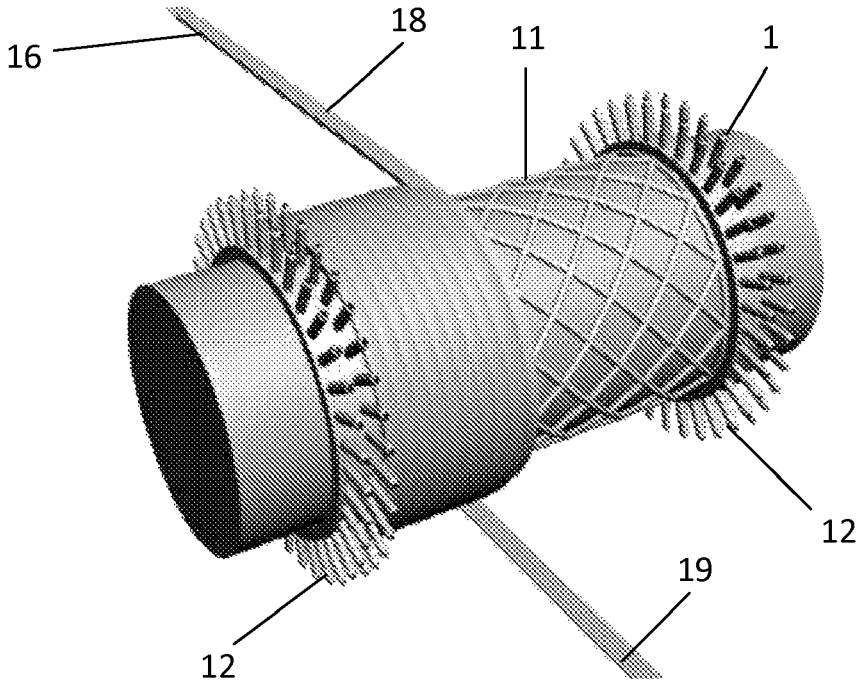
FIG. 16 represents the mandrel, previously manufactured internal bandage, side bandages with pins, the first layer of metal wire, the layer of impregnated insulation tape being wound on top of the metal wire and a helical layer of impregnated glass fiber being wound on top of the insulation tape.
Figure 17:
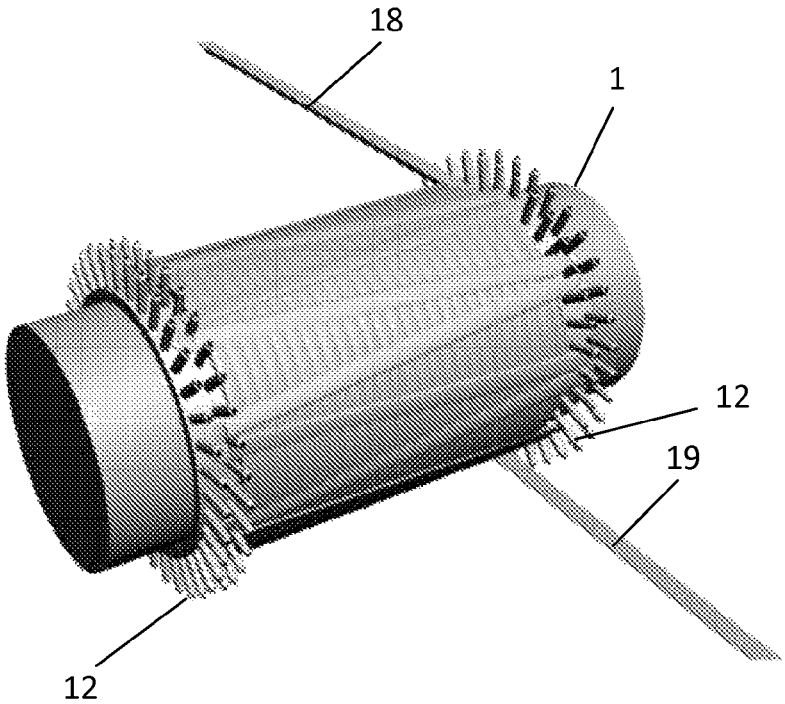
FIG. 17 represents the mandrel, side bandages with pins, the completed first layer of metal wire, the completed layer of impregnated insulation tape wound on top of the layer of metal wire and helical and axial layers of impregnated glass fiber being wound on top of the insulation tape.

It is demonstrated in FIG. 16 how glass fiber reinforcement can be introduced into the winding. The impregnated glass fiber roving 19 can come from a separate moving table. In the considered example the moving table with a feeding system for the glass fiber is situated on the side opposite to the moving table where feeding systems for the metal wire and insulation tape are installed. This allows relative motion of the glass fiber with respect to the winding. In FIG. 17 it is shown how an axial layer can be introduced into the winding by utilizing zigzag motion of the glass fiber roving. The winding shown in FIG. 17 has both radial and axial reinforcement on top of the first layer of wound metal wires. The radial reinforcement layers can be wound with winding angle in the range from 45° to 90° with respect to the axis of rotation of the mandrel. The axial reinforcement layers can be wound with winding angle in the range from 0° to 45° with respect to the axis of rotation of the mandrel.

Figure 18:
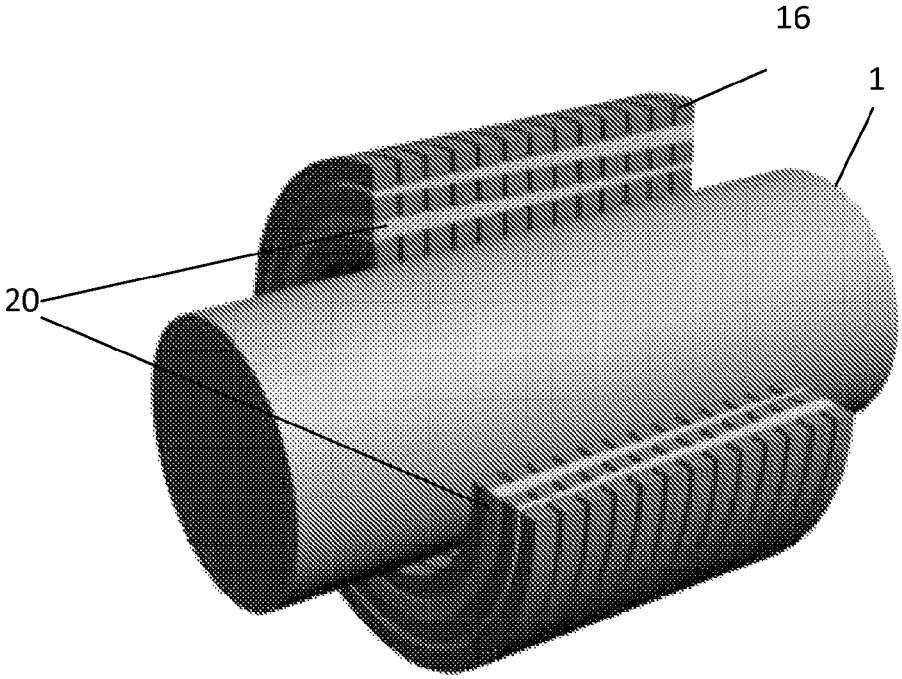
FIG. 18 represents a mandrel and a cross-section of a cylindrical winding with interlayer insulation layers corresponding to the actual voltage gradient between the winding layers.

The winding approach proposed in the presented invention allows solving tasks which have not been solved so far in the conventional winding technology. In FIG. 18 a winding consisting of 3 layers of metal wire is shown. The first layer is wound from left to right. The second layer is wound from right to left and the last layer is wound from left to right. At the end of the first layer and the beginning of the second layer the interlayer voltage is minimal.

Figure 19:
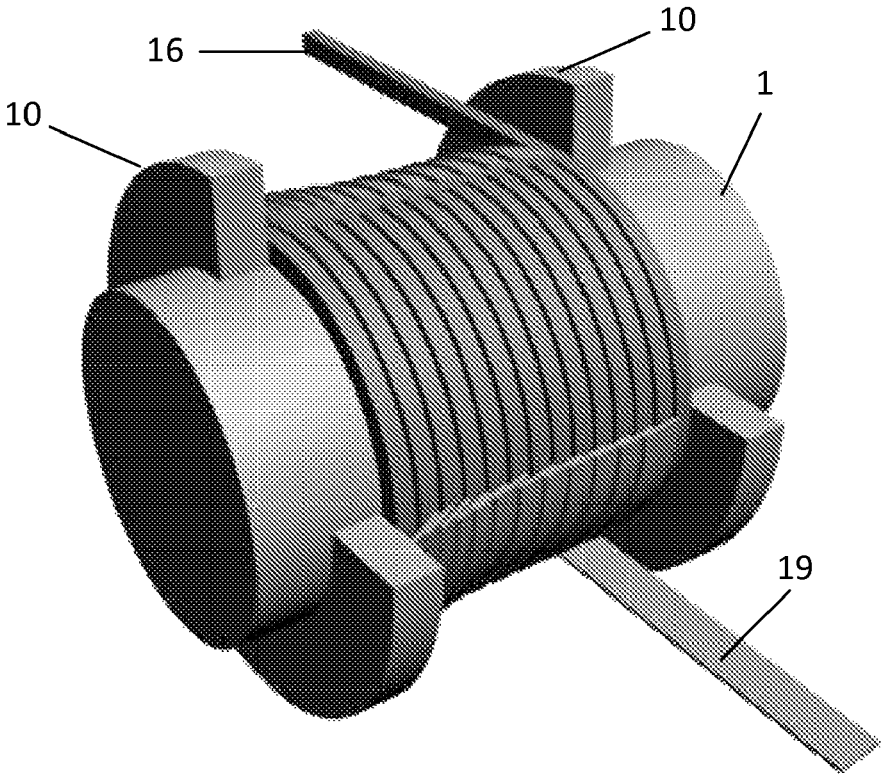
FIG. 19 represents a mandrel, a couple of side rings and simultaneous winding with metal wire and with impregnated insulation tape with variable overlapping of the insulation tape in order to obtain insulation gradient.

Obviously the interlayer voltage is maximal between the beginning of the first layer and the end of the second layer. Therefore the first interlayer insulation 20 has to be manufactured accordingly, having the lowest thickness at the end of the first metal wire layer and the maximum thickness at the beginning of the first metal wire layer. The opposite should be done on top of the second metal wire layer. This task can be accomplished by introducing a relative motion between the impregnated insulation tape and the metal wire. A possible solution is shown in FIG. 19. The metal wire 16 and the impregnated glass fiber roving 19 or the insulation tape 18 (FIGS. 15-17) are being fed from two separate moving tables. Notice that overlapping of the impregnated insulation tape is the biggest at the beginning of the first metal wire layer and the lowest at the end of the first metal layer. Thereby the required insulation gradient is achieved. Besides, the interlayer insulation can also have a constant thickness. In this case the thickness of the interlayer insulation must be in accordance with the required insulation strength of the winding on its whole length. As an option, mentioned interlayer insulation gradient can be incorporated into the wire insulation as demonstrated in FIG. 20.

High-Temperature Lead-Glass Windings

The operational thermal limit is determined by the limit of insulation. If high temperature insulation is required, lead glass can be used. Lead glass has sufficiently low viscosity at 800° C. Since melting temperature of copper is around 1080° C., winding with a copper wire can be carried out in a liquid glass the same way as in a polymer compound.

In order to provide internal insulation, a set of high-temperature glass spacers can be installed on the mandrel. A set of slots in side rings can be used for keeping these plates in place. After that liquid glass can be poured on a turning steel mandrel. Winding with copper wire would be carried out directly in the liquid glass. The copper wire can also be pulled through a bath with liquid glass. This could help reducing the amount of voids in the glass. Winding with copper wire must be carried out with a specified axial spacing in order to provide inter-turn insulation. After each new winding layer is completed, a corresponding set of high-temperature glass spacers would be introduced into the winding.

Glass spacers can optionally have a hollow profile in order to provide passage for a cooling liquid through the winding.

Since in this case there are no fabric-like materials in this type of winding, the winding can also be manufactured dry. The glass spacers would be fixed in place by conventional tape materials and when wire comes above these spacers, the tape can be removed.

The dry winding structure can be preheated up to 800-900° C. in order to avoid thermal stresses due to contact with liquid lead glass. After that lead glass can be poured into the winding. When the winding cools down, the difference in thermal expansion between glass and steel, would allow easy extraction of the winding from the mandrel.

Such a winding is suitable for high-temperature applications. Besides, since glass unlike polymers is working well with water, there would be more options for selecting cooling medium.

In addition to that, such a winding allows considerably higher internal thermal gradients. So the number of cooling channels can be reduced.

Oil-Immersed Windings

In case of oil-immersed windings cooling channels have to be provided both in the radial and in the axial direction.

Filling the winding with thermally conducting compound is not needed in this case. However sufficient insulation and mechanical strength have to be provided.

Figure 21:
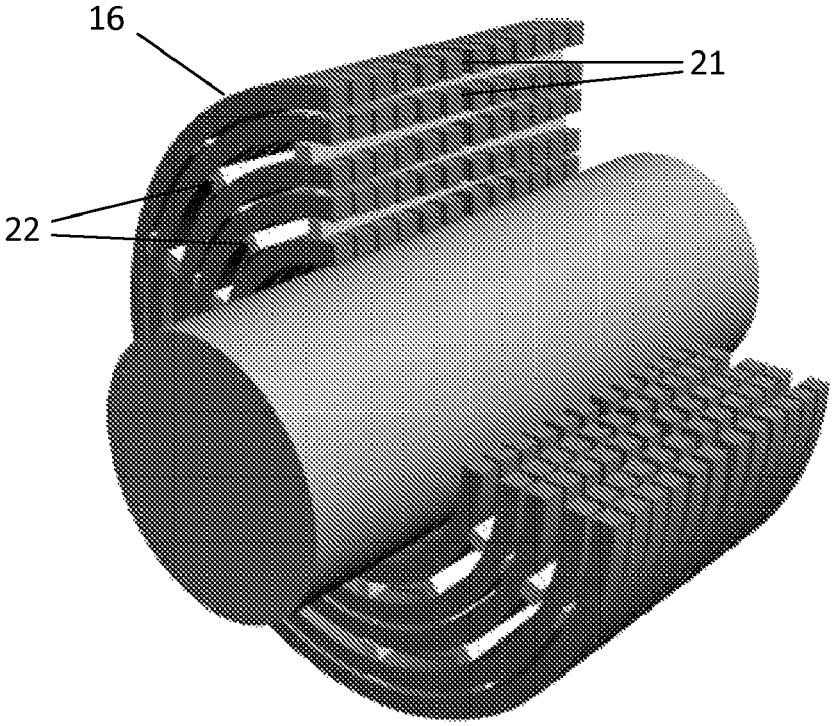
FIG. 21 represents a mandrel, a cross-section of a cylindrical winding wound with a variable gap between wires and planks with wedge profile in order to provide interlayer insulation and cooling channels.

The internal layer has to be made of impregnated glass fiber as shown in FIG. 6. If necessary, this layer may contain an extra layer of impregnated insulation tape. Radial channels 21 can be provided by introducing variable step between turns in layers of metal wire. Axial channels 22 can be obtained by means of layers of connected planks or spacers (FIG. 21). These spacers can have a shape of wedge in order to account for the voltage gradient between winding layers. In addition to spacers, continuous insulation layers and side insulation rings can be introduced between sections of the winding as described earlier. In order to achieve high electrical strength of interlayer insulation, insulation tapes can be impregnated with oil before reaching the winding.

Figure 22:
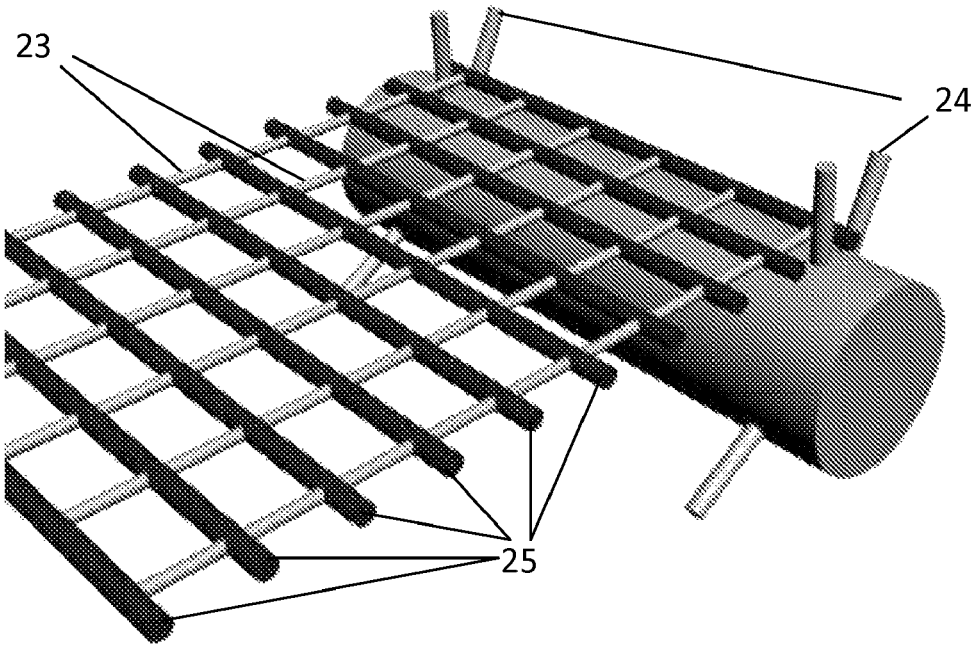
FIG. 22 represents fixation of the beginning of a ribbon made of connected planks on a mandrel using a set of pins.
Figure 23:
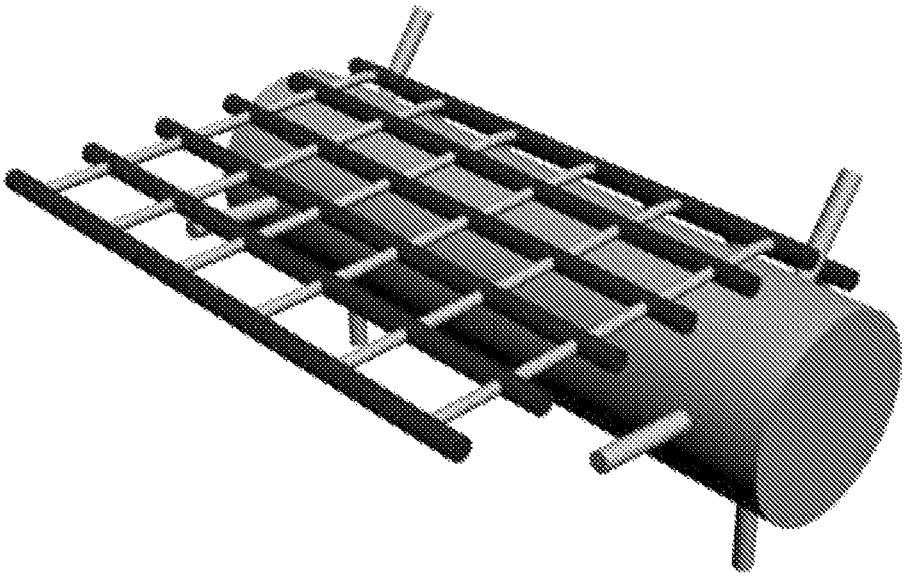
FIG. 23 represents winding with a ribbon made of connected planks on a mandrel using a set of pins.
Figure 24:
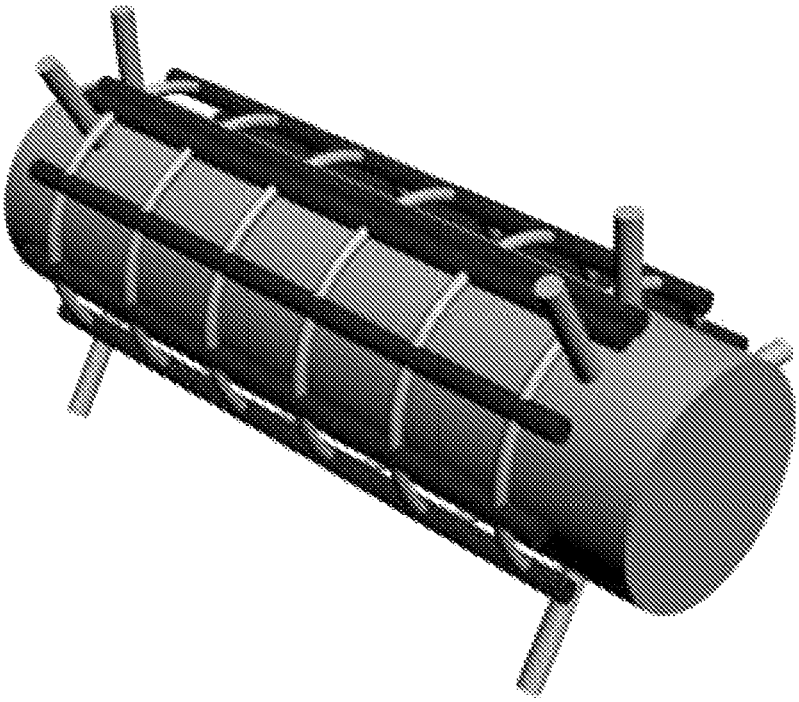
FIG. 24 represents fixation of the end of a ribbon made of connected planks on a mandrel using a set of pins.

FIG. 22 shows how a layer of connected spacers 23 can be fixed on the winding. A few pins 24 on the mandrel would be sufficient for this. FIG. 23 shows how the layer of planks 25 can be wound and FIG. 24 shows how the end of the layer of connected spacers can eventually be fixed.

As the winding is finished, the end wire has to be fixed while preserving pretension in the metal wire. This will allow maintaining pretension in the winding. Pretension in the winding has the same effect as if the winding stands under pressure from outside. It leads to internal friction between wires and spacers. By applying pretension during winding with metal wire a certain level of prestress can be achieved in the winding.

In order to preserve and optionally increase these friction forces, an external glass fiber layer can optionally be wound on the completed winding. This external layer could be also wound with pretension. As an alternative an impregnated wide glass fiber fabric with optional openings for radial cooling could be wrapped around the winding. The inner support cylinder of the winding has to be sufficiently rigid in order to contain the outer pressure applied by the winding. After that, if there are elements containing non-cured polymer, curing has to be performed.

Introducing Axial Cooling Channels in the Air-Cooled Windings

Figure 25:
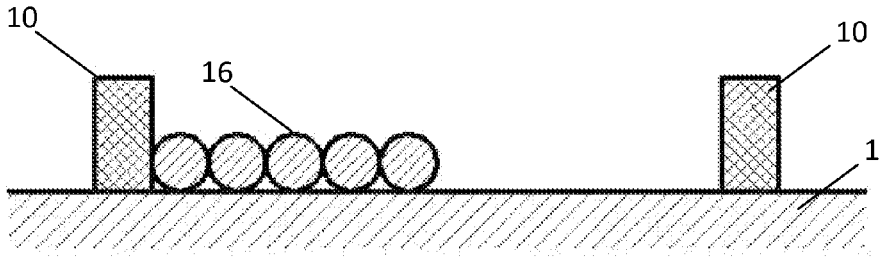
FIG. 25 represents a mandrel, a couple of side rings and winding the first layer with metal wire.
Figure 26:
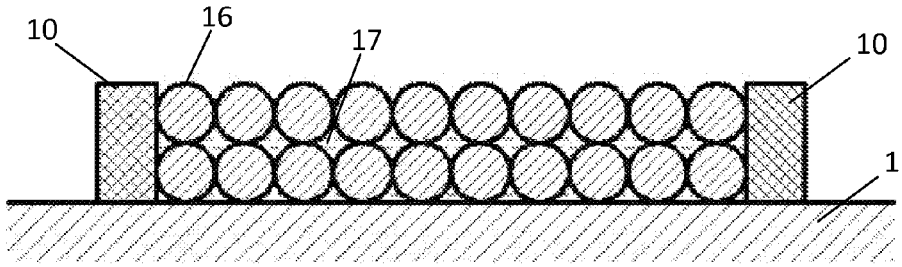
FIG. 26 represents the mandrel, a couple of side rings, two completed first layers of metal wire.
Figure 27:
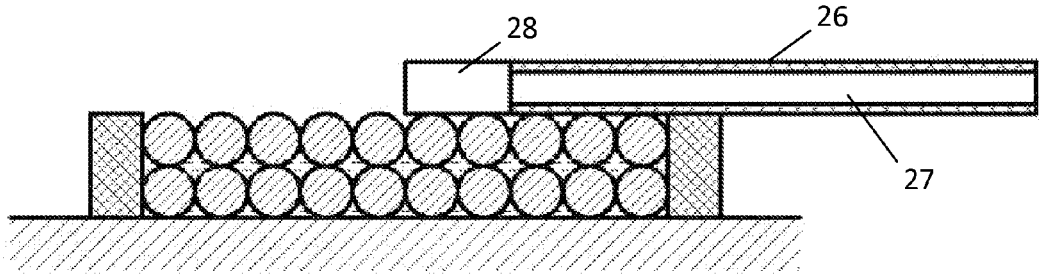
FIG. 27 represents the mandrel, a couple of side rings, two completed first layers of metal wire and an intermediate insulation layer being inserted over the winding.
Figure 28:
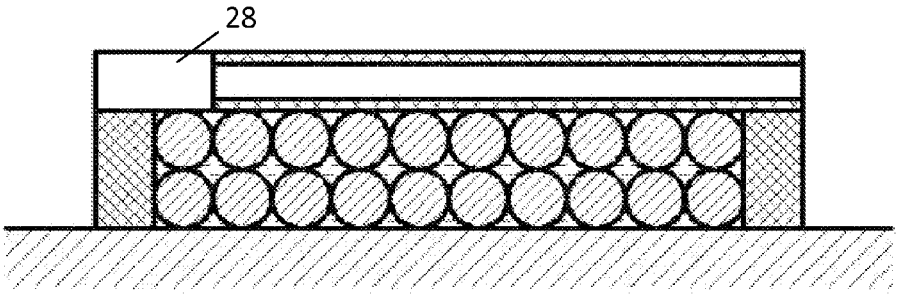
FIG. 28 represents the mandrel, a couple of side rings, two completed first layers of metal wire and an intermediate insulation layer being installed over the winding.
Figure 29:
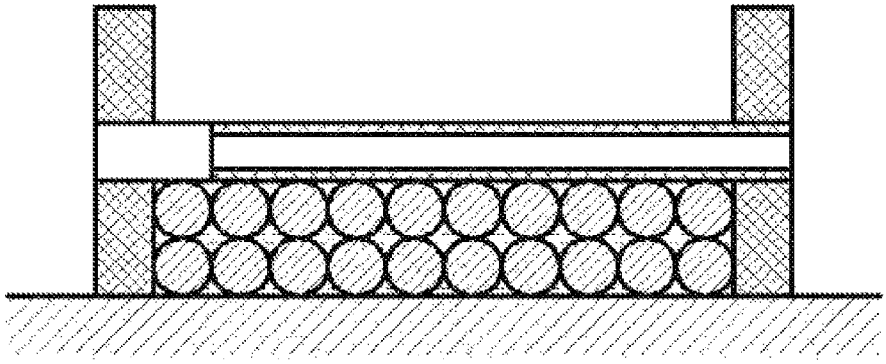
FIG. 29 represents the mandrel, a couple of side rings, two completed first layers of metal wire, the intermediate insulation layer and two external side rings.
Figure 30:
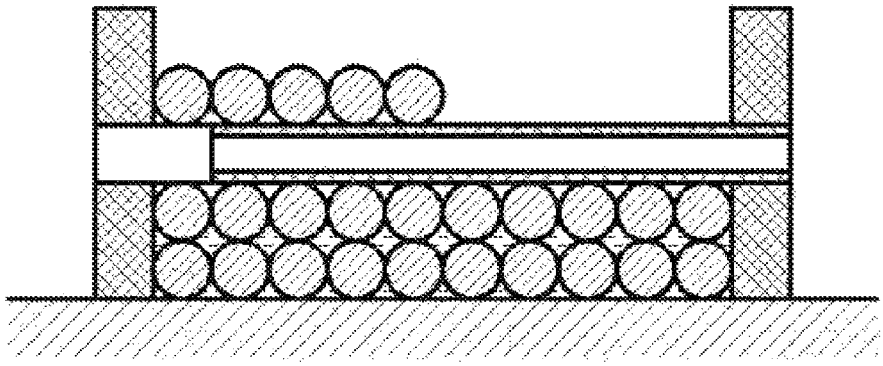
FIG. 30 represents the mandrel, internal and external side rings, two completed first layers of metal wire, the intermediate insulation layer and the third layer of metal wire being wound.
Figure 31:
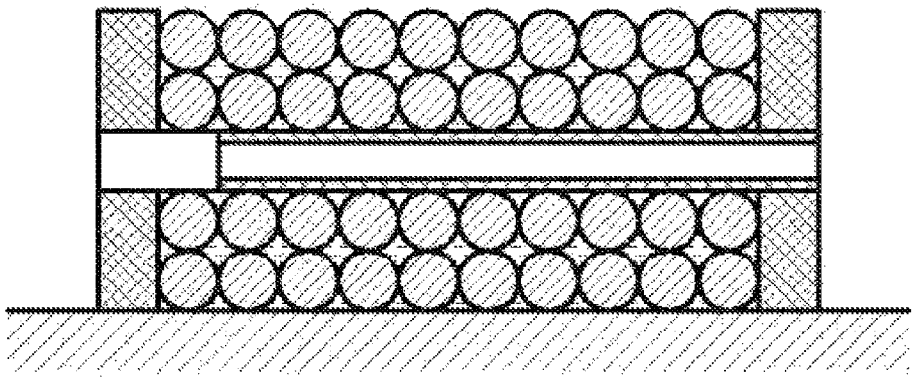
FIG. 31 represents the mandrel, internal and external side rings, two completed first layers of metal wire, the intermediate insulation layer and completed second section of the winding.
Figure 32:
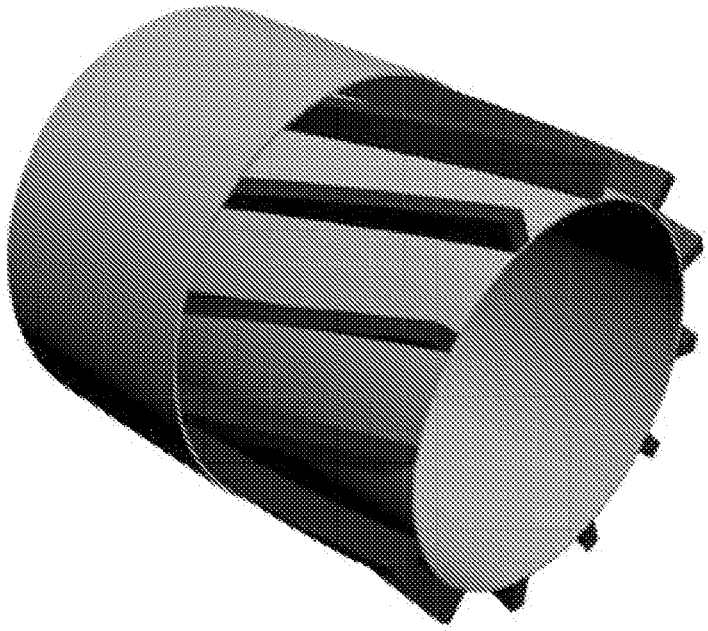
FIG. 32 represents the internal structure of an intermediate insulation layer.
Figure 33:
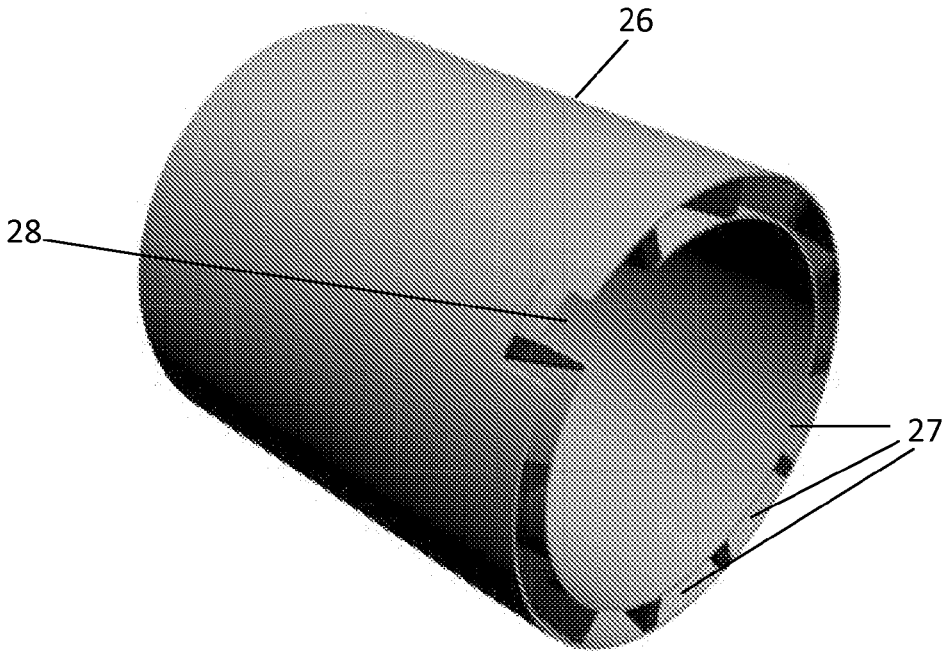
FIG. 33 represents a complete view of the intermediate insulation layer with a slot on the side for the metal wire.

Starting from a certain volume of the winding internal temperature can become excessively high. This requires introduction of axial cooling channels. These channels can be introduced as follows. After a section of the winding is completed (FIG. 25 and FIG. 26), a previously manufactured bandage 26 with internal cooling channels 27 is slid over the section (FIG. 27 and FIG. 28) and installed (or wound) side rings. The bandage has a slot 28 on the front side. This slot must fit the wire connecting the feeding system and the winding. After that a pair of side rings has to be installed (or wound) on top of the bandage for the next section and described procedure is repeated again (FIG. 30 and FIG. 31). A possible shape of an intermediate bandage is shown in FIG. 32 and FIG. 33.

Providing Side Rings and Interlayer Insulation for High Voltage Windings

Figure 34:
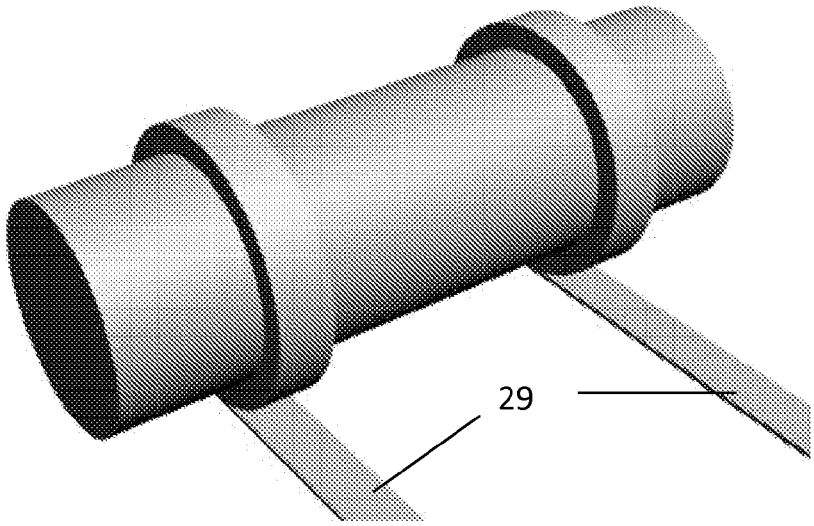
FIG. 34 represents simultaneous winding with two impregnated insulation tapes for producing two side rings.

In high voltage applications side insulation rings are required. These insulation rings can also be wound using a single separate or a few separate moving tables 5 (FIG. 2, FIG. 34). Since insulation tape may have a much higher electrical strength compared to compound, it is important to achieve a good overlapping between neighboring insulation tapes both in insulation side rings and in the interlayer insulation.

Figure 35:
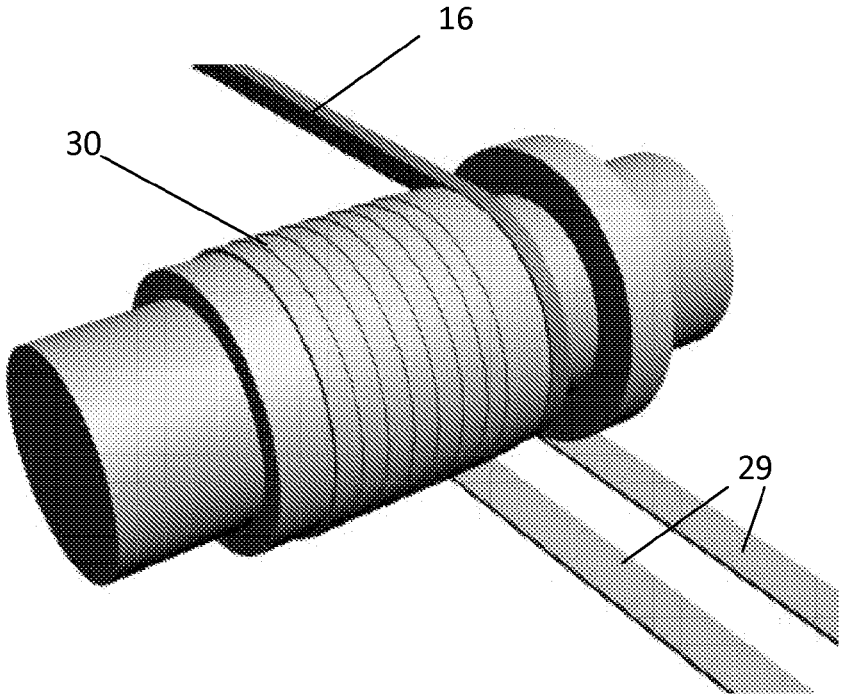
FIG. 35 represents simultaneous winding with two impregnated insulation tapes for providing a side ring and interlayer insulation.
Figure 36:
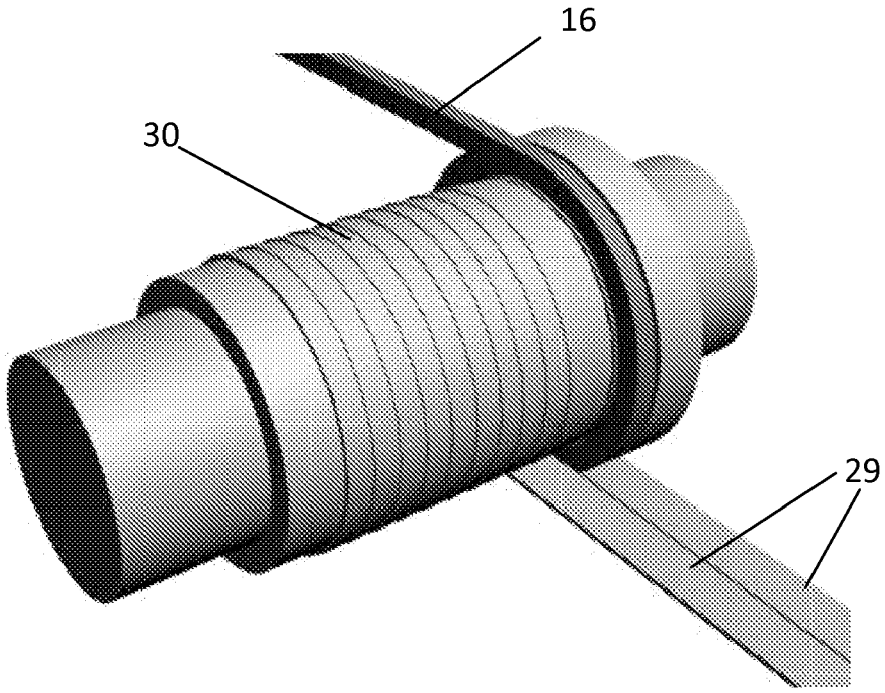
FIG. 36 represents simultaneous winding with metal wire and two impregnated insulation tapes and transition by the metal wire to the next layer.
Figure 37:
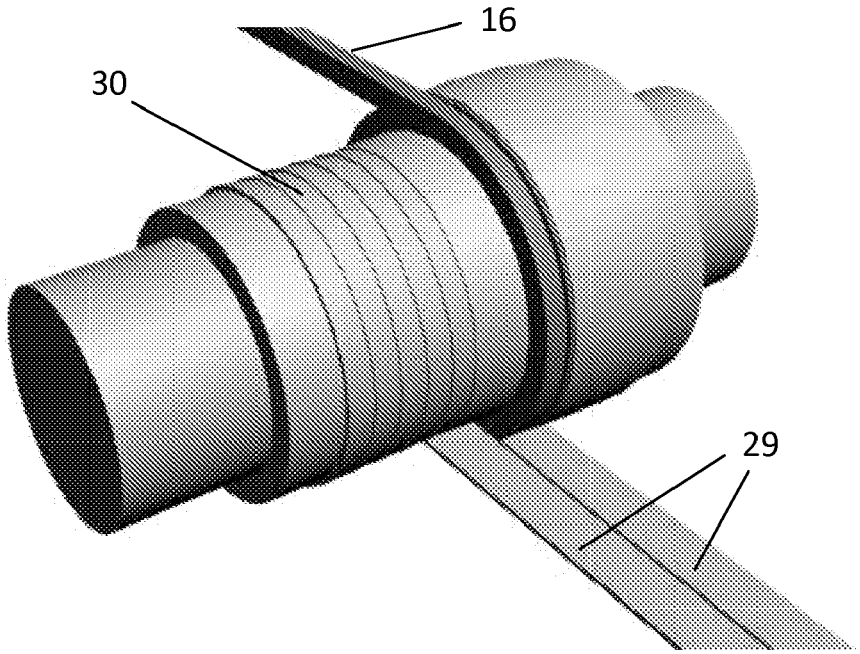
FIG. 37 represents simultaneous winding with metal wire and two impregnated insulation tapes with both tapes used for interlayer insulation.

In FIGS. 35-37 it is shown that impregnated insulation tapes can be used both for winding insulation side rings 29 and interlayer insulation 30. In this case good overlapping can be guaranteed.

Figure 38:
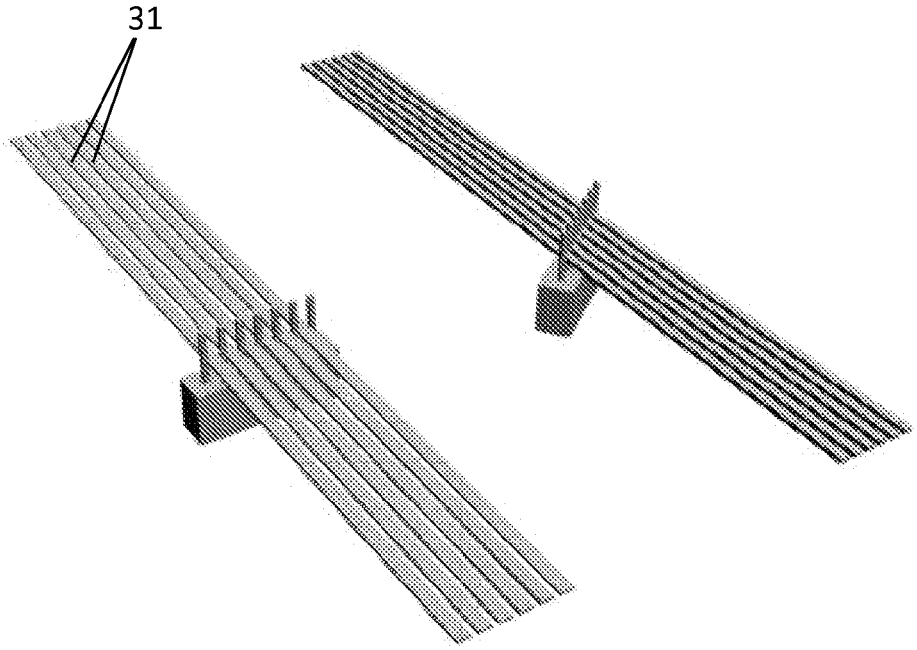
FIG. 38 represents modification of the width and thickness of a glass fiber tape by turning guiding elements in the winding eye.

If insulation is manufactured from impregnated glass fiber, the glass fiber tape consists of individual rovings 31 (FIG. 38). In order to prevent overlapping between these rovings, they are passed through slots in a guiding element inside the winding eye. Guiding elements can be provided with an extra degree of freedom allowing different angles with respect to the winding direction. This would automatically modify width and thickness of the glass fiber tape and match thickness buildup in the side rings with the speed of making winding layers with wire.

Figure 39:
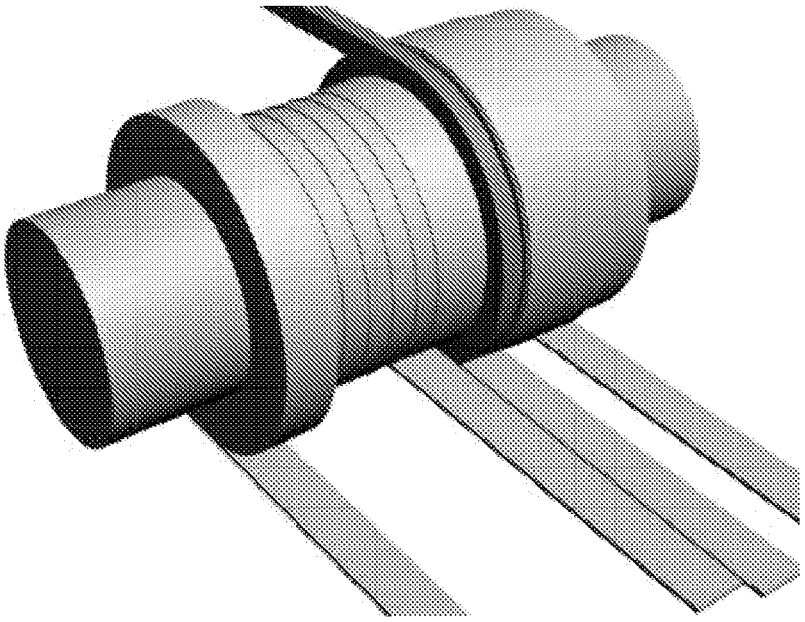
FIG. 39 represents simultaneous winding with metal wire and four impregnated insulation tapes with two tapes used for interlayer insulation and other two tapes used for winding insulation side rings.

FIG. 39 shows how four impregnated insulation tapes can be used for simultaneous winding—of interlayer insulation and insulation side rings. Depending on actual electrical strength requirements a mixture of different insulation tapes can be used. Since outer insulation tapes used for winding insulation rings do not require axial movement, they can be supplied from static feeding systems. Internal insulation tapes used for winding interlayer insulation can be supplied either from one or two moving tables depending on whether an interlayer insulation gradient is necessary or not.

As shown in FIG. 2 and FIG. 39, feeding systems can be installed on different levels with respect to the axis of the mandrel.

Such an approach has an advantage of providing good impregnation of insulation tape, necessary overlapping between impregnated insulation tapes and transition of interlayer insulation into insulation side rings. Since interlayer insulation and insulation side rings are wound together with metal wire in one manufacturing step, there is a complete correspondence of all parts between each other. This winding procedure is suitable for complete automation.

Introducing Intermediate Reinforcement Rings

Figure 40:
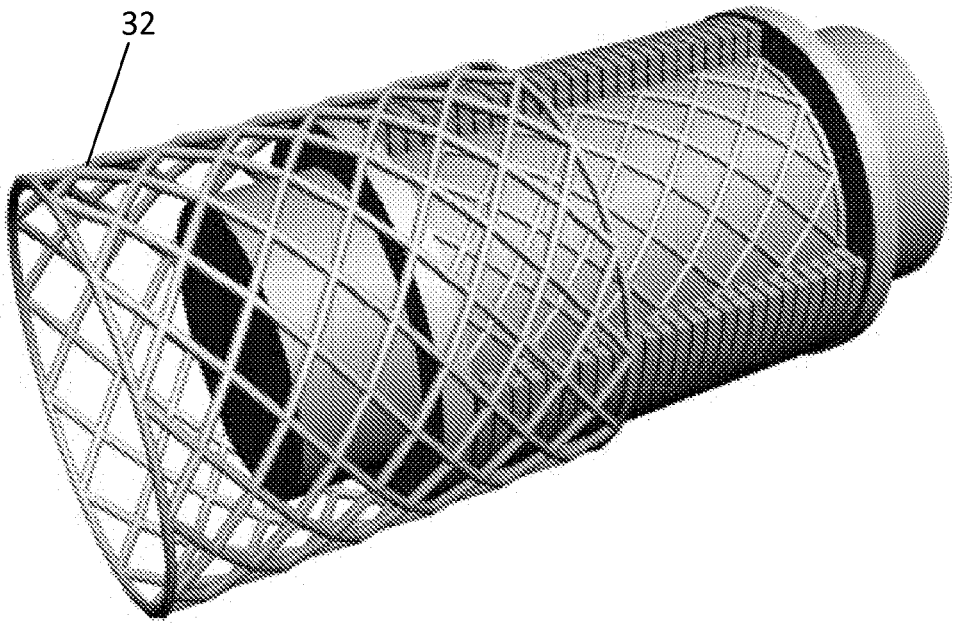
FIG. 40 represents installation of an intermediate reinforcing bandage with radial openings over the winding.

In large transformers mechanical rigidity of the winding is an important issue. A combination of previously manufactured reinforcement sleeves 32 slid over winding sections (FIG. 40) and winding with metal wires with specified pretension allows creating an internal prestress (compression) in the winding. The reinforcement sleeves can contain cylindrical reinforcement layers with winding angle in the range from 45° to 90° with respect to the axis of rotation of the mandrel as well as axial reinforcement layers with winding angle in the range from 0° to 45° with respect to the axis of rotation of the mandrel.

Introducing of rigid reinforcement rings requires a close match between dimensions of reinforcement rings and the winding. This is not a big issue for series production. For small series production it is also possible to use braided sleeves. These sleeves can be made with considerable opening as in a previously manufactured sleeve (28 in FIG. 33). These openings would remain even if the sleeve is impregnated. Braided sleeves can be easily cut and handled manually.

Figure 41:
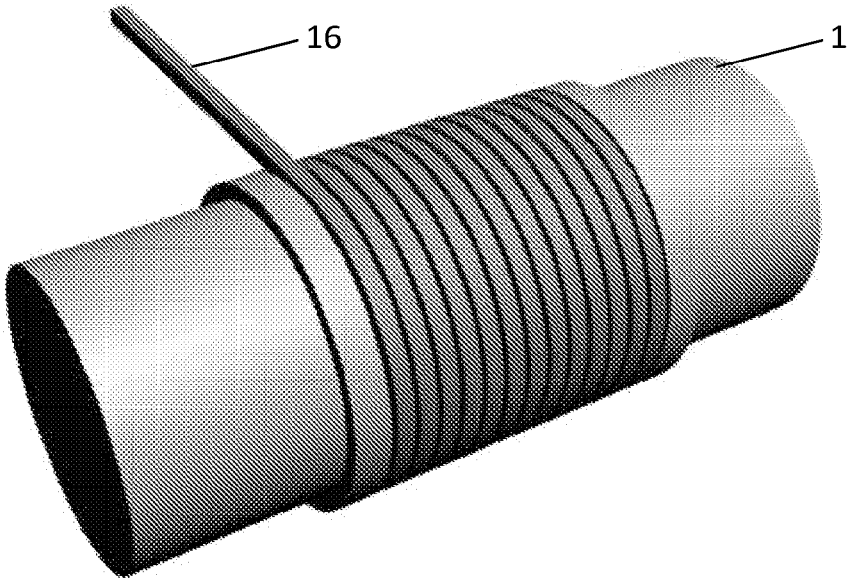
FIG. 41 shows a completed layer of an electrical winding before installation of a braided sleeve.
Figure 42:
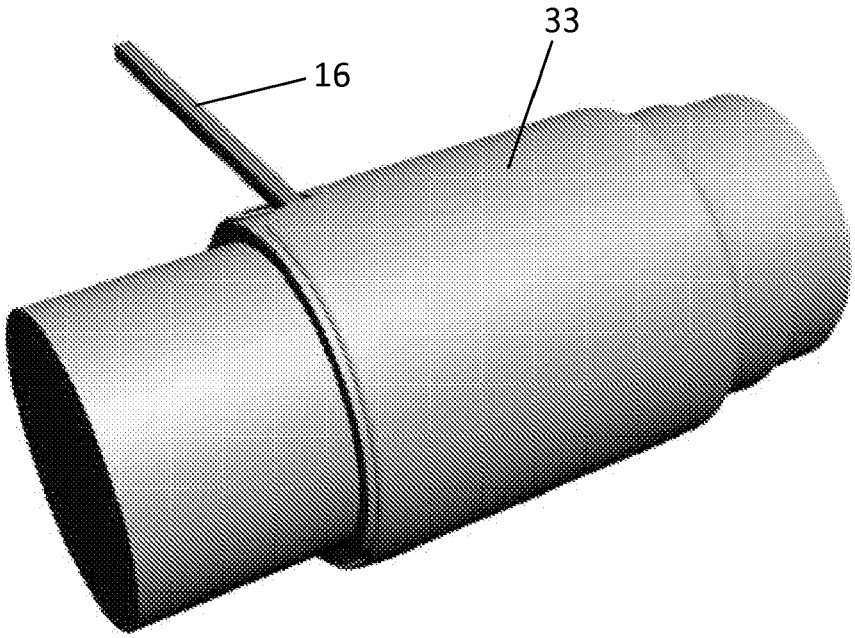
FIG. 42 represents a completed layer of an electrical winding after installation of a braided sleeve.

FIG. 41 demonstrates a completed layer of winding. The side rings can be wound as demonstrated in FIGS. 34 and 35. In order to introduce axial reinforcement the winding can be put on hold. The electrical winding must be continuous. This requirement is not so strict for the side rings. The winding of a side ring can be interrupted and restarted without any impact on its quality. FIG. 41 shows the winding of side rings being interrupted. This permits sliding a braded sleeve over the winding as shown in FIG. 42. The optional opening in the sleeve should fit the wire. After that the winding could go into the next level and manufacturing of side rings can be restarted. A layer of axially oriented impregnated glass fiber fabrics can also be rolled over the completed winding layer. However it is important that this layer is in contact with the both side rings.

Vacuuming

In order to further reduce amount of air in the insulation, the winding can be set into the vacuum chamber. Since winding can become fairly thick, it might be difficult to extract all the entrapped air through the winding surface.

Vacuuming can also be conducted on the winding machine by utilizing vacuum bagging technique. If it is necessary to get as small amount of voids as possible, vacuum bagging can be conducted multiple times.

Alternatively vacuuming can be carried out on the pieces of insulating material which are about to be introduced into the winding. For instance, impregnated braided sleeves or impregnated sheets of glass-fiber fabric used as intermediate reinforcement can be put into a vacuum chamber before introducing into the winding.

High-Voltage Windings with Cross-Linked Polyethylene

Cross-linked polyethylene has superior electrical strength compared to conventional polymers. Therefore this material has become popular as insulation material for cables. A few trials have recently been made for introducing cross-linked polyethylene in air-cooled transformer windings. The most straightforward solution is to take a cable with cross-linked polyethylene and make a winding with it. Although such a winding can allow higher operational voltage thanks to superior electrical strength of this type of insulation, such a winding is impractical due to very low copper filling factor and consequently reduced thermal load. The proposed technology allows more efficient use of this material with a few adjustments described further. As mentioned previously, insulation must be manufactured in accordance with the local electrical field in the winding. This way the winding can be made more compact. Besides, the winding temperature would be reduced.

Figure 20:
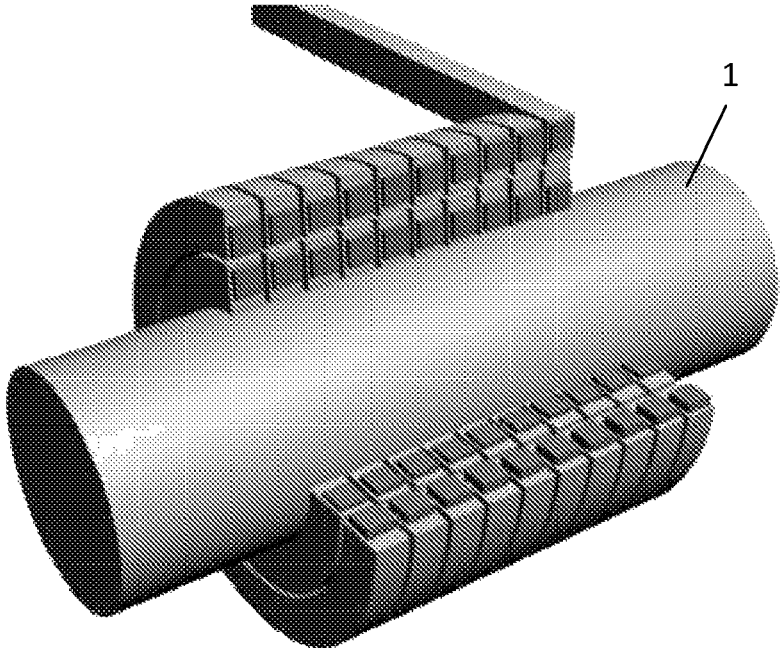
FIG. 20 represents a cylindrical winding with a variable wire insulation.

The inter turn voltage in cylindrical windings is relatively small and remains constant for all layers. On the other hand, the interlayer voltage above the wire and below the wire is generally not the same. However the sum of these voltages is practically constant for all the turns. So by displacing the wire within insulation to the top or to the bottom, an according change in the electrical strength could be achieved (FIG. 20). The amount of insulation and the cross-section of the wire with insulation would remain constant. This modification can be implemented by introducing cross-linked polyethylene directly onto the wire during winding through, for instance, extrusion. The wire would have to be displaced vertically in the extrusion eye in order to account for the required electrical strength (FIG. 20). Advantage of this approach is that electrical loading on the insulation would be uniform throughout the winding. PEX-C polyethylene technique would be preferable due to its speed. However other methods could also be applied.

Consolidation of thermoplasts requires application of pressure and temperature. These conditions can be easily met in the proposed technique. The pressure can be obtained by applying pretension to the wire, which is fairly easy, because the end wire is fixed and prevents unwinding. Application of pretension results in contact pressure between neighboring layers. Alternatively, the contact pressure could be applied with the help of a pair of rolls. One roll would provide radial compression in order to achieve consolidation between the wire that is being wound and the winding. The second roll would provide consolidation between the wire and either the side ring or the previous turn. Both rolls could be incorporated into the winding eye. Heating could be conducted with a laser or another heating element. If an insulation layer is situated between layers, this technique would still work and sufficient consolidation could be achieved. However either temperature or contact pressure would have to be adjusted. Skilled in the art would be able to find a balance between applied pretension and temperature for each specific winding condition. Notice that this approach could be extended to wires with insulation of polyetheretherketone (PEEK) or another thermoplastic material. Pressure buildup from winding layers can lead to problems with extraction from the mandrel. In that case winding could be carried out directly on a previously manufactured rigid glass-fiber bandage made on basis of the same type of polymer as the one used in the winding.

PEX-A Polyethylene

There are different types of cross-linked polyethylene. PEX-A is produced by heating polyethylene above crystal melting point. This process is somewhat similar to the production process of lead-glass windings.

Figure 43:
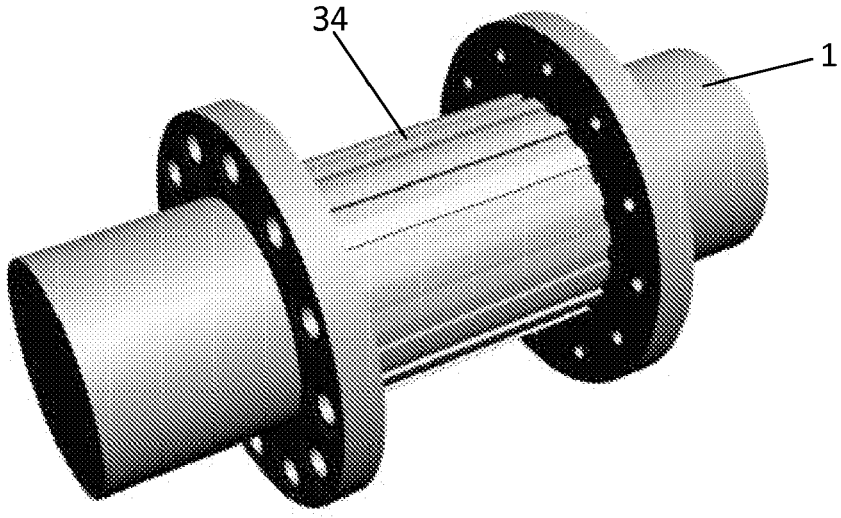
FIG. 43 represents a mandrel with side rings and a set of spacers on it.
Figure 44:
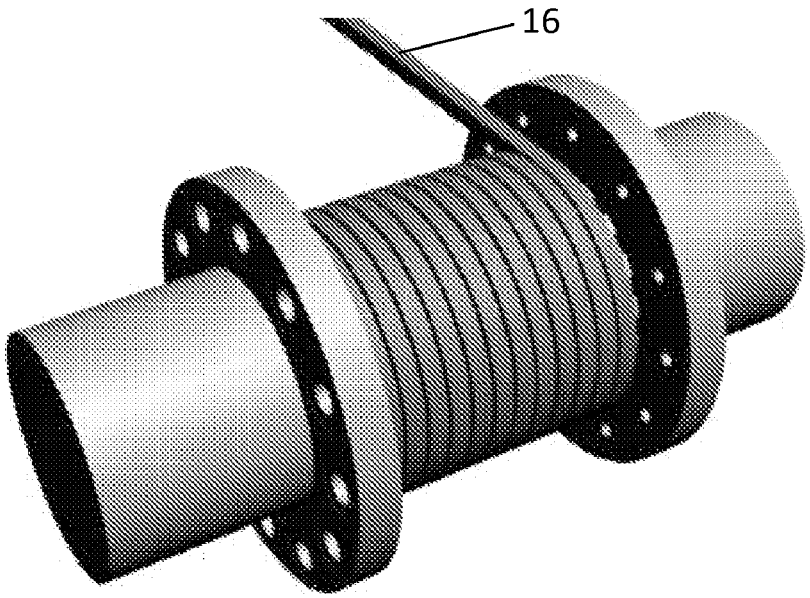
FIG. 44 shows the first winding layer completed.
Figure 45:
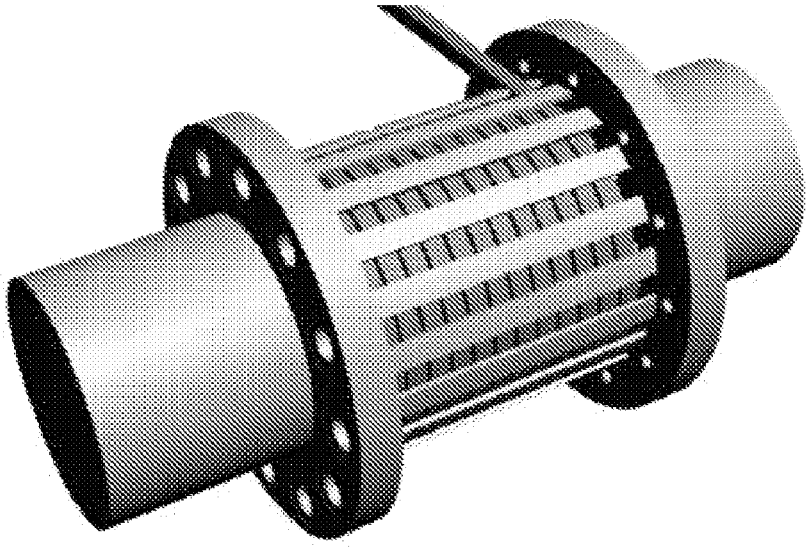
FIG. 45 shows the second set of spacers installed on the winding.
Figure 46:
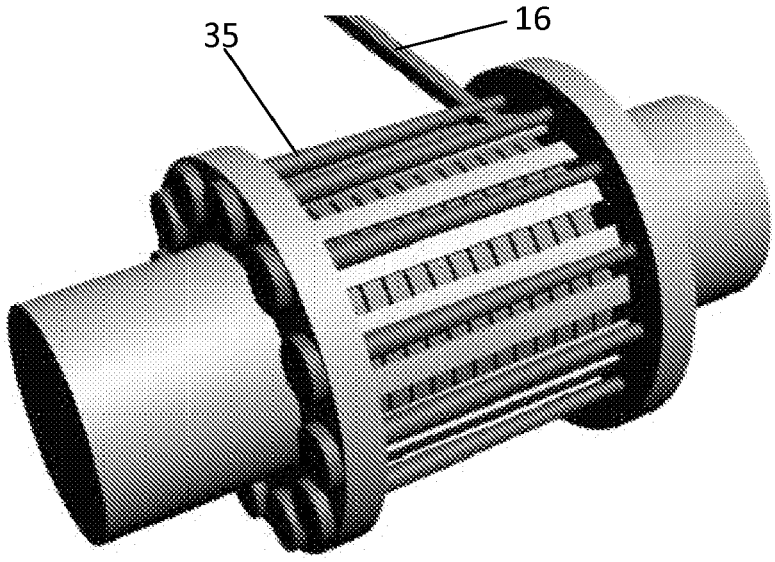
FIG. 46 shows a set of inserts installed through the side rings.

Before starting the winding, a set of spacers must be installed on the mandrel (FIG. 43). These spacers must either be of glass or of a glass-fiber composite with polyethylene as a matrix. The wire can either be pulled through a bath with liquid polyethylene or winding can be performed directly in the liquid polyethylene. Upon completion of each winding layer (FIG. 44) a set of spacers must be installed on the winding in order to provide interlayer insulation (FIG. 45). These spacers must be either of glass or of a glass-fiber composite with polyethylene as a matrix or of another insulating material with suitable maximum operation temperature. In order to provide cooling channels in the winding a set of inserts can be introduced into the winding through corresponding holes in the side rings. As described before, glass-fiber with polyethylene can be introduced in parallel into the winding. When the winding process is finished, the whole winding must be placed in an autoclave and heated up to 300-400° C. in inert atmosphere under pressure of 22-24 bar. Glass is capable of sustaining such temperature. So it would prevent displacement of layers with respect to each other. As for the inserts, they can be extracted by pressing the side rings off the winding. Polyetheretherketone (PEEK) could be used as an alternative to glass.

PEX-B Polyethylene

PEX-B is produced by "moisture curing". Advantage of this process is that no high temperatures are required for manufacturing this type of cross-linked polyethylene. This process allows using less thermally stable materials as spacers between winding layers compared to PEX-A.

PEX-C Polyethylene

PEX-C is obtained through electron-beam processing. This process is fast and economical, but not suitable for thick pipes. This problem can be solved by applying electron-beam processing during winding. The primary goal here is to provide reliable interlayer insulation. Interlayer insulation is not that thick and can obtain sufficient amount of radiation if winding speed is adjusted in accordance with the power of the source. Since no high temperatures are required in this process, the spacers can be made of polyethylene that has already passed cross-linking process.

PERT Polyethylene

Polyethylene of Raised Temperature resistance (PERT) was developed by Dow Chemical Company. This type of linear polyethylene is provided in granules and can be melted at 240° C. In this case a broad range of materials can be used as spacers. Winding can be carried out either in melt PERT polyethylene with subsequent introduction of spacers into it or by filling a dry winding with liquid PERT polyethylene. All kinds of cross-linked polyethylene and PERT polyethylene can be used for turn insulation of wires.

Curing

Curing cycle is defined by the type of polymer used in the compound and impregnation of reinforcement fibers and insulation tapes. As was mentioned earlier a varnish can also be used if this is required for achieving necessary electrical strength. The mandrel has to rotate during curing in order to preserve the compound in the winding.

Since curing is done at elevated temperatures, the viscosity of polymer decreases. Therefore turning speed of the mandrel has to be readjusted.

As the winding and the mandrel are warmed up, the mandrel expands. Therefore it is preferable to have a mandrel of either the same metal as material of the wire used for the winding or a metal with higher thermal expansion compared to the material of the wire. During curing polymer would most likely shrink, which is a common feature of most polymers and varnishes. This leads to a certain pressure on the mandrel. After curing, as the winding and the mandrel cool down, the mandrel would shrink more than the winding. This reduces the pressure due to shrinkage of the polymer and can even provide a little air-gap between the mandrel and the winding. In the proposed technique the winding is wound using a number of materials. So an effective thermal expansion of the winding is influenced by the exact composition. For instance, cylindrical layers of glass fiber reinforcement reduce radial thermal expansion of the winding.

Most polymers allow a range of curing temperatures. This can be used to facilitate release of the winding. The mandrel should be heated up to the maximum allowable curing temperature of the polymer used in the winding and the outer temperature of the winding can be maintained at the lowest curing limit. In this case the average winding temperature is smaller compared to the temperature of the mandrel. So after curing a larger shrinkage of the mandrel can be achieved.

Extraction of the Winding

If the difference between thermal expansion coefficients of the mandrel and the winding was insufficient for a smooth release of manufactured windings, these windings can be extracted by applying an axial force. The axial force applied during extraction is determined by the length of the winding wound on the mandrel or the total length of all windings wound on the same mandrel. Introducing taper in the mandrel reduces the extraction force.

Extractability of the winding is also determined by its axial strength, i.e. by the maximum force the winding can sustain. Therefore introducing axial layers might be a necessary measure for reaching the axial strength needed for extraction of the winding.

A few windings can be manufactured next to each other on the same mandrel. If the axial strength of the manufactured windings is sufficient, they can be extracted all at once. Alternatively, these windings can be extracted sequentially by utilizing according configuration of side rings. It is intended that the illustrative and descriptive material herein to be used to illustrate the principles of the invention and not to limit the scope thereof.

Introducing Stress in the Winding

Introduction of glass-fiber reinforcement increases the radial and axial stiffness of the winding. So forces acting on the winding would lead to considerably smaller displacements and deformations compared to the same winding without said reinforcement. Protection against excessive strains would increase reliability and operational life of insulation. However the proposed structure does not exclude tensile stresses in insulation completely. These stresses can be removed by bringing the winding into a global compressive state.

After the winding is fully cured it would have a solid structure and hard surface. The winding can be brought into global compression by winding a few layers with glass or carbon fiber tapes with or without polymer under specified pretension. The higher is applied tension, the thinner would be this external bandage. If winding contains axial reinforcement of glass fiber composite connected to both side rings, the radial compression would lead to Poisson effect in isotropic materials within the winding. This means that these materials would tend to expand axially. On the other hand, axially oriented glass fiber bandages have fairly small Poisson factor. So these bandages would not tend to expand axially if subjected to radial compression. Such combination of properties would lead to additional compression in isotropic materials and tension in axially oriented composite layers. This way a global compressive stress would be achieved in insulation materials within the winding.

The value of this compressive stress should exceed possible operational tensile stresses in the winding, which have to be determined for each case individually. If radial compression is applied to the winding, the internal radial reinforcement would be unnecessary. Instead, the radial intermediate layers can be manufactured from other insulation materials which could be possibly weaker mechanically but possess superior electrical strength. The inner support of the winding must be strong enough to coup with applied compression. With regard to high-temperature lead-glass windings, glass is a fragile material that performs fairly well under compression. By applying outer pressure to the winding fracture of the glass due to operational stresses can be prevented. If radial cooling channels have to be provided, the outer layer can be wound with some openings. Alternatively a set of previously manufactured cylinders can be installed on the winding with a prescribed distance.

Stress can also serve a technological purpose. Low level of porosity in insulation can be achieved by application of pressure to each layer. The pressure can be applied by introducing pretension during winding with metal wire.

In case of glass fiber also some pretension could be applied, because glass fiber has high tensile strength. On the other hand, alternative insulation materials, such as, for instance, mica tape, are more fragile and would not allow high pretension. Pretension results in contact pressure and helps pushing air out of the polymer. So the pressure applied by the metal wire could help compensate for possibly low pretension applied during winding with insulation tapes.

Since liquid polymer is being pushed out of glass fiber, higher fiber content could be achieved in intermediate layers. Therefore insulation would be more compact. However since polymer is liquid, it would simply adjust to the new conditions and no considerable residual pressure would remain after curing.

In order to bring polymer and all of the winding under pressure, said additional extra layer wound with pretension on top of the winding would be required. Pressure in the polymer would reduce the risk of internal cracking during operation of the winding.

Multi-Layer Winding for Dry Transformers

Figure 47:
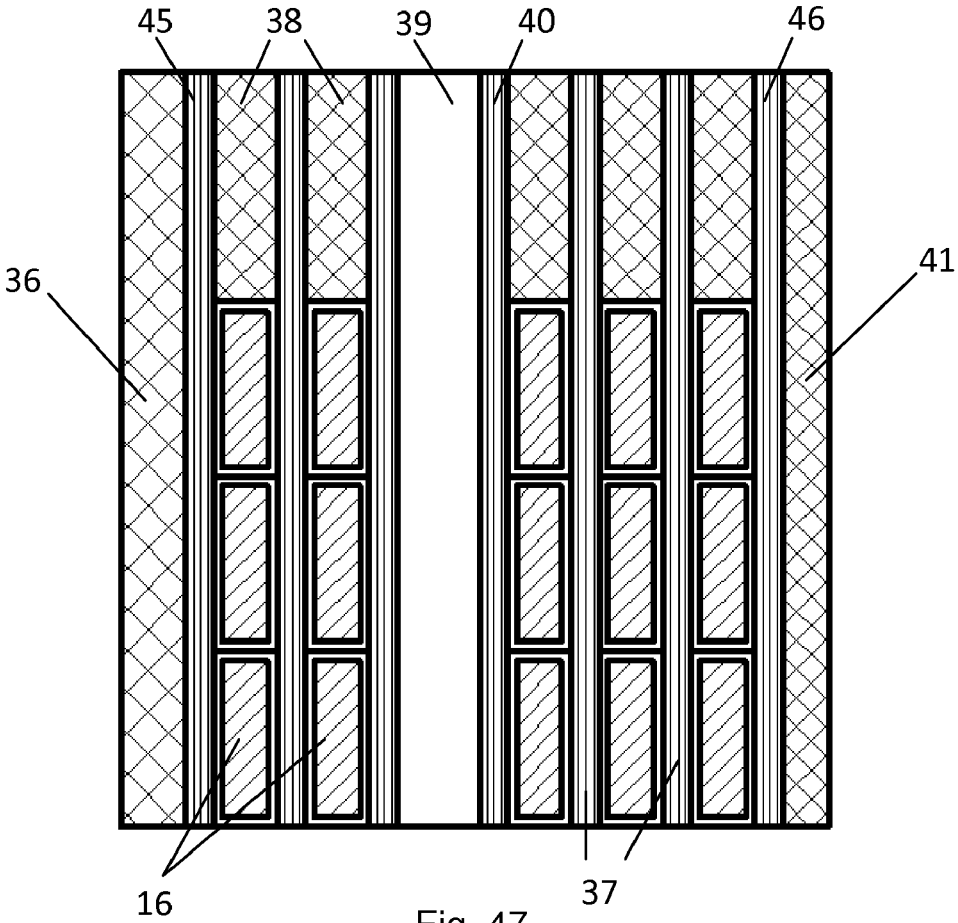
FIG. 47 shows top part of winding of oil-immersed transformer.
Figure 48:
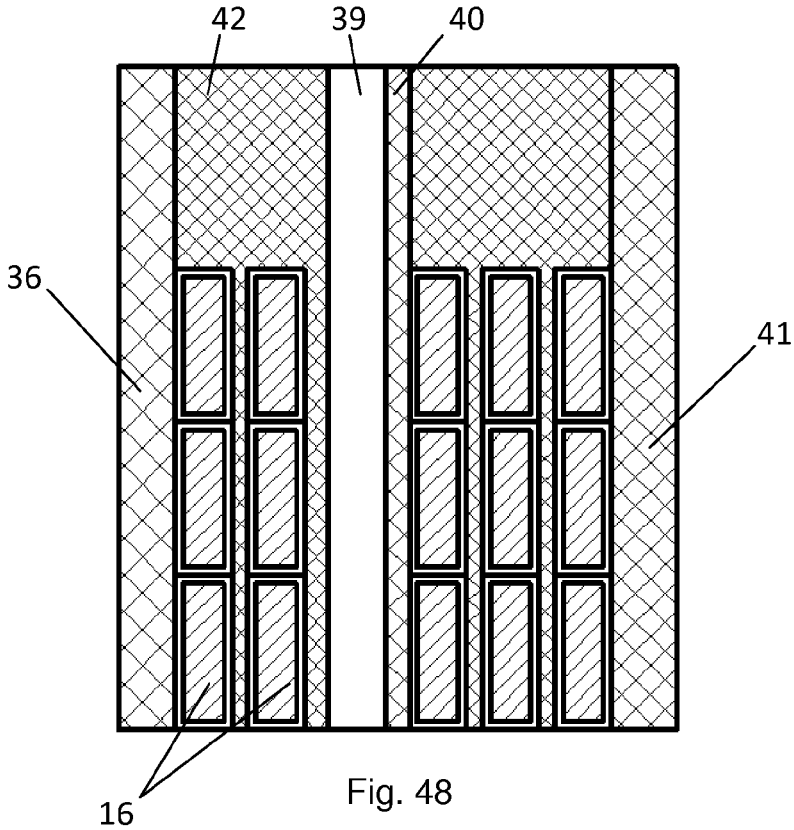
FIG. 48 shows the top part of a winding of a dry transformer with fiber-glass insulation and with cooling channels.
Figure 49:
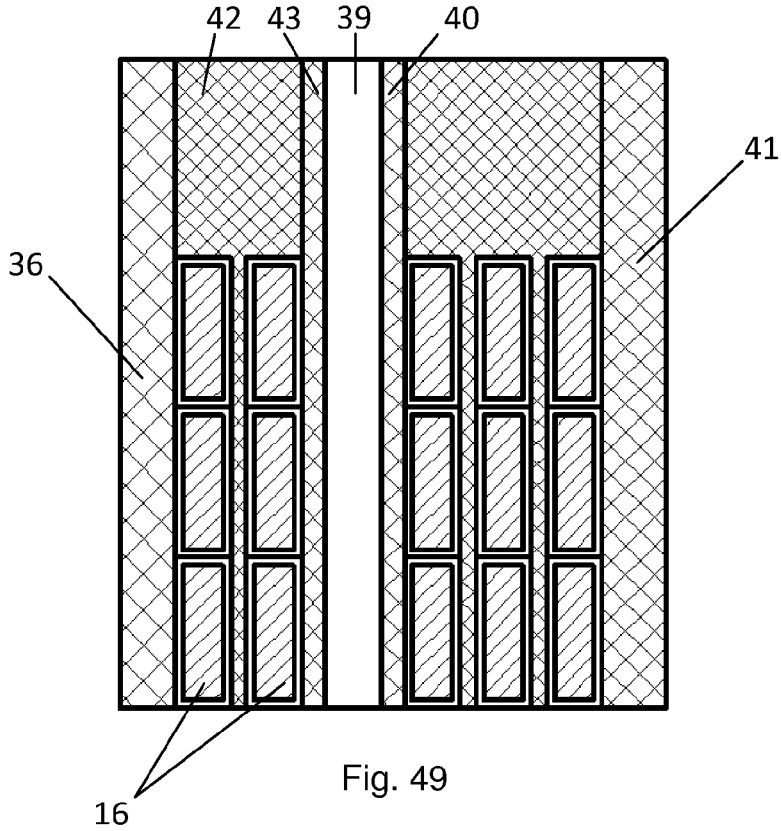
FIG. 49 shows the top part of a winding of a dry transformer with fiber-glass insulation, with cooling channels and with additional stress bandage.

On the basis of the described technology, it is possible to make multi-layer windings of dry transformers. A top part of a multi-layer winding of the dry transformer is presented on FIGS. 48-49. The first layer of the winding is wound on a preliminary made glass textolite cylinder 36 or on a glass textolite cylinder 36 that was previously wound on the mandrel. A round or rectangular wire 16 of copper or aluminum, having enamel turn insulation or polyimide turn insulation, is wound in a layer of liquid epoxy resin. Simultaneously with winding with wires, a layer of butt-end insulation of the winding from either fiber glass or from a glass filament tape (38 FIG. 47) is wound. The thickness of this insulation is equal to the thickness of the wire. The interlayer insulation from fiber glass or from a glass filament tape (37 FIG. 47) is wound for the full axial length of the winding either after winding of a layer of wires or simultaneously with winding of a layer of wires. Further the following layer of wires and the butt-end insulation of the winding are wound. Then an interlayer insulation of fiber glass or a glass filament tape is wound for the axial length of the winding and so on. In order to prevent unwinding, secure position of the wire, increase insulation density in the winding and for pushing the air out of epoxy resin the wire is wound with pretension.

The first and last layers of the butt-end insulation 38 are made separately in order to provide an output for the winding terminals. Said first and last layers represent fiberglass rings with a notch for a winding terminal. The shape of a bottom face of the butt-end insulation rings 38, intended for output of winding terminals, should correspond to the shape of the butt-end of the winding. The butt-end insulation rings 38 should have a tight contact with wires of the winding. The butt-end insulation ring 38, intended for output of the inner layer of the winding, is glued with epoxy resin to the outer surface of the internal support cylinder 36. The terminal wire of the inner layer of the winding is prepared and fixed after installation of the specified insulation ring. After that winding of the inner layer is performed and the butt-end insulation is wound on the other side of the winding. When the first layer of the winding is completed, an interlayer insulation is wound with pretension on top of the obtained layer, as described in paragraph [0103]. The notch that provides passage for the terminal wire should be completely filled with epoxy resin. The butt-end insulation ring 38, intended for the terminal wire of an outer layer of the winding, is installed similarly.

If necessary, air cooling channels 39 are introduced in the winding. A layer of spacers or planks positioned in accordance with FIGS. 22-24 provides a cooling channel. Then a support cylinder of fiber glass or glass filament tape 40 is wound on the layer of spacers. Winding of wire and glass fiber or the glass filament tape continues further as it is specified in the paragraph [0103].

When winding of wire is completed, a bandage of glass fiber or glass filament tape 41 is wound on top of the winding. The last layers of the bandage 41 are wound with carbon fiber. The specified bandage creates compression in the winding in order to increase mechanical strength of the winding against mechanical loads due to short circuit, and also for increasing electrical strength of the winding. It is obvious that higher effective compression could be achieved in the winding if cooling channels are not present.

In order to obtain a more homogeneous compression in the winding, intermediate bandages from fiber glass or from a glass filament tape 43 can be wound on the winding. For windings with cooling channels an intermediate bandage should be wound before installing a cooling channel (43 FIG. 49).

The butt-end and interlayer insulation will represent a solid homogeneous structure (42 FIG. 48, 49) as a result of continuous winding of the interlayer insulation and the butt-end insulation. A similar uniformity of insulation can be encountered in cast transformer windings. Unlike cast transformer windings, described cylindrical windings possess considerable mechanical strength. As windings made according to the RESIBLOCK technology, proposed windings would be resistant to crack initiation and propagation. Since the interlayer and the butt-end insulation are made from a good insulation material, such as E-glass fiber, proposed windings would also have high insulation strength.

If necessary, capacitance rings could be manufactured in the winding, which is of interest for high-voltage transformers. It is possible to wind capacitance rings insulated by a layer of fiber glass as described above on an internal and external surface of the transformer winding. In the last layer of the winding tapping coils can be wound. Manufacturing of capacitance rings and tapping coils is completely integrated into the proposed technology.

Multi-Layer Winding of Oil-Immersed Transformers

On the basis of the described technology it is also possible to make multi-layer windings of oil-immersed transformers. A top part of a multi-layer winding of an oil transformer is presented on FIG. 47. A preliminary made fiberglass cylinder 36 or a fiberglass cylinder 36, which could have been wound on the mandrel, serves as an internal support for the winding. Some layers of a paper tape 45 are wound on the support cylinder for insulation strengthening. The paper tape is a tape of cable paper preliminary impregnated with transformer oil. The paper tape can be wound with pretension either with an axial step between turns equal to the tape width or with an axial step of half the tape width. If the axial step is equal to the tape width, the following layer of the tape is wound with an offset of half the tape width. The first winding layer of a round or rectangular wire 16, of copper or aluminum, with paper turn insulation, is wound on the specified layer of the cable paper. A layer of the butt-end insulation of the winding 38 is wound with a paper tape simultaneously with winding with wire. The thickness of the butt-end insulation equals to the wire thickness. An interlayer insulation 37 of the specified paper tape is wound on the full axial length of the winding either simultaneously with winding with wires or when winding with wires is put on hold. Next the following layer of wires and butt-end insulation are wound. Then an interlayer insulation of the paper tape is wound on the full axial length of the winding and so on. After winding the last layer of wires the butt-end insulation is wound. The last insulation layer 46 is wound over the winding on the full axial length of the winding. The thickness of this layer is at least equal to the thickness of insulation between winding layers. Some of the last insulation layers 46 are wound with a dry paper tape. The wire is wound with pretension in order to avoid unwinding of the wire, increase density of paper insulation of the winding and in order to press out air from the space between layers of paper tape.

In order to provide output for winding terminals, the first and the last layers of the butt-end insulation 38 are made preliminary as in case of the described dry transformer winding. Said preliminary made butt-end insulation has a shape of rings of glued or pressed electric grade paperboard with a notch for winding terminals. The shape of the bottom face of the butt-end insulation rings 38, intended for output of winding terminals, should match the shape of the butt-end of the winding. The butt-end insulation rings 38 should have a tight contact with wires of the winding. The butt-end insulation ring 38, intended for output of the inner layer of the winding, is fixed on the surface of the support cylinder 36 by means of, for instance, technological clamps. The terminal wire of the internal winding layer is prepared and fixed after installation of the specified insulation ring. After that winding of the inner layer is performed and the butt-end insulation is wound on the other side of the winding. When the first layer is completed, an interlayer insulation of a paper tape is wound with pretension on top of the first layer as described in paragraph [0110]. The notch that provides a passage for the terminal wire should be completely filled with epoxy resin. The butt-end insulation ring 38, intended for the terminal wire of an outer winding layer, is installed similarly.

When winding with wire is completed, the bandage of fiber glass or of a glass fiber tape 41 is wound on the winding. The last layers of the bandage 41 are made of carbon fiber. The specified bandage creates compression in a winding in order to increase mechanical strength of the winding against the mechanical loads of short circuit, and in order to increase insulation strength of the winding.

The butt-end and interlayer insulation will represent a homogeneous structure (42 FIG. 48, 49) as a result of continuous winding of the interlayer insulation and the butt-end insulation. Additional uniformity would be achieved through compression of the winding by means of bandage 41, as in cast transformer windings.

Multi-Layer Winding of Dry Transformers with Insulation from Polyethylene

Figure 50:
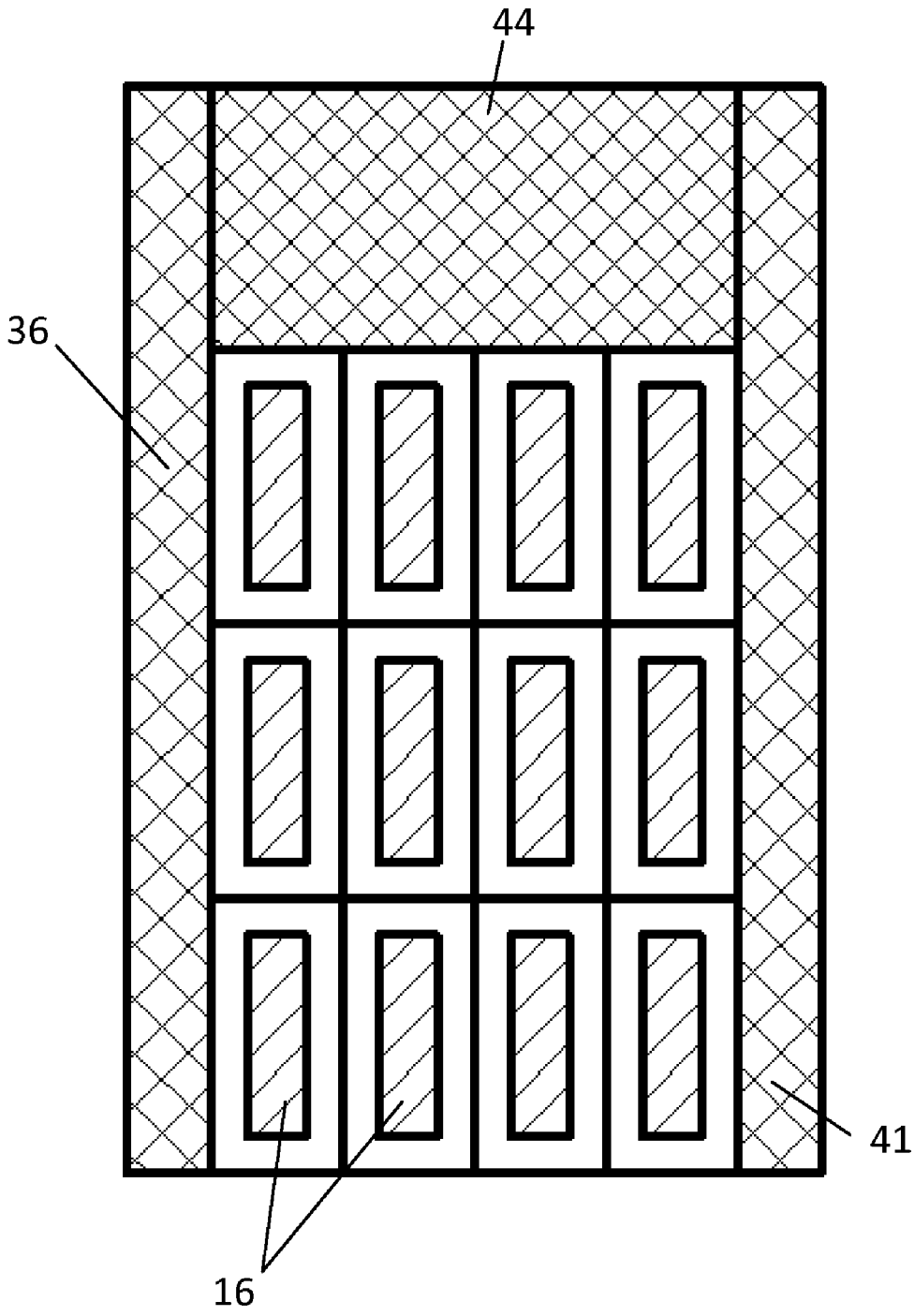
FIG. 50 shows the top part of a winding of a dry transformer with polyethylene insulation.

The described technology allows manufacturing multi-layer windings of dry transformers with insulation from polyethylene. A top part of a multi-layer winding of the dry transformer with insulation from polyethylene is presented on FIG. 50. Preliminary made butt-end insulation rings from the cross-linked polyethylene or polyethylene PERT 44 are mounted on a preliminary made glass textolite cylinder or on a fiberglass cylinder 36 which could have been wound on a mandrel. One of the butt-end insulation rings 44 has holes (notches) for the winding terminals, directed along the winding axis. Before starting with winding the terminal wire of the internal layer of the winding is prepared and fixed in a hole of the butt-end insulation ring 44. The winding is carried out with preliminary made copper or aluminum rectangular wire with turn insulation from cross-linked polyethylene or PERT polyethylene. The required number of layers of the specified rectangular wire 16 is wound on the support cylinder 36. In the end of winding operation the terminal wire of the last layer is prepared and fixed in a hole of the butt-end insulation ring 44. The wire is wound with pretension in order to avoid unwinding of the wire and increase winding density.

After winding operation is completed, the winding is heated up to the temperature of softening of polyethylene (120-125° C.). The butt-end insulation rings 44 are axially fixed. Then a bandage from fiber glass or from a glass fiber tape 41 is wound on the winding and butt-end insulation rings. The last layers of a bandage 41 are made of carbon fiber. The specified bandage creates compression in the winding in order to increase mechanical strength of the winding against mechanical loads of short circuit, and in order to enforce consolidation of polyethylene insulation in all internal volume of the winding, and also in order to increase insulation strength of the winding.

Consolidation of polyethylene in the internal volume of the winding will occur due to heating of the winding up to temperature of softening of polyethylene and application of compression by means of the bandage 41. After consolidation process is completed, the wire insulation and the butt-end insulation rings would form a uniform polyethylene structure. Besides, as a result of compression polyethylene density would increase and, therefore, its insulation strength would increase.

There are two methods of getting of monolithic structure using the turn insulation and the butt-end insulation rings. The turn insulation of the wire during the winding process is heated up to temperature of a softening of polyethylene (120-125° C.), for example, by means of inductive heating, in case of the first method. As a result of pretension of the wire and/or creation of pressure upon the wire by means of rollers, the turn insulation of wires and the butt-end insulation rings will consolidate in a monolithic polyethylene structure. Rollers should apply pressure on the wire in two directions. Radial pressure should be applied in order to achieve consolidation between the wire and outer surface of the previous layer of the winding. Axial pressure is required in order to achieve consolidation between the wire and the previous turn or between the wire and the butt-end ring.

In the second method the winding is wound in a cold state. Wires of the winding can be glued together during the winding process in order to avoid unwinding of a wire. After winding operation is completed, the winding is heated up to the temperature of softening of polyethylene (120-125° C.). Then the winding is put in a press mold or in an autoclave. The winding is compressed at a high pressure exceeding 2-3 MPa. After cooling of the winding, the turn insulation and the butt-end insulation rings will form a uniform polyethylene structure.

Then a bandage from fiber glass or from a glass fiber tape 41 is wound on the winding and butt-end insulation rings. The last layers of a bandage 41 are made of carbon fiber. The specified bandage creates compression in the winding in order to increase mechanical strength of the winding against mechanical loads of short circuit and also in order to increase insulation strength of the winding.

A polyethylene-free space in the butt-end insulation rings 44 and around the terminal wires of the winding is filled with polyethylene by means of extruding of polyethylene to the specified space.

Multi-Layer Winding of Dry Transformers with Polyimide Insulation

The described technology allows manufacturing multi-layer windings of dry transformers with polyimide insulation. A top part of a multi-layer winding of a dry transformer with polyimide insulation is presented on FIG. 48. An internal support for the winding can be provided by a preliminary made glass textolite cylinder 36 or a fiberglass cylinder 36, which could have been wound on a mandrel. Winding is conducted with pretension on the internal support cylinder 36 with a rectangular wire 16, from copper or aluminum, with polyimide wire insulation and a thin layer of glue. A layer of the butt-end insulation of the winding is wound with polyimide tapes with a gluing layer (38 FIG. 47) with pretension simultaneously with winding with wire. The thickness of the layer of butt-end insulation is equal to the thickness of the wire. The polyimide tape can be wound either with an axial step of the tape width between turns or with a step of a half of the tape width. If the tape is wound with the axial step of the tape width, the following layer of the tape is wound with an offset of a half of the tape width. The interlayer insulation from the polyimide tape with gluing layer (37 FIG. 47) is wound for the full axial length of the winding either simultaneously with winding with wire or when winding with wire is put on hold. Next the following layer of wires and the butt-end insulation of the winding are wound. Then an insulation layer from a polyimide tape is wound on the full axial length of the winding and so on. The tape is pressed by a roller against the winding during winding operation in order to improve the quality of gluing of the tape and in order to avoid air inclusions.

A bandage of fiber glass or of the glass fiber tape 41 is wound on the winding upon completion of winding with wire. The last layers of the bandage 41 are wound with carbon fiber. The specified bandage creates compression in the winding in order to increase mechanical strength of the winding against mechanical loads due to short circuit, and also in order to increase the insulation strength of the winding.

The butt-end and interlayer insulation will represent a homogeneous structure (42 FIG. 48, 49) as a result of continuous winding of the interlayer insulation and the butt-end insulation. Additional uniformity would be achieved through compression of the winding by means of bandage 41, as in previous cases.

Polyimide films have high insulation strength. This advantage together with benefits provided by the proposed technology would allow achieving thinner interlayer insulation for high-voltage transformers. Additionally, polyimide insulation has a high thermal resistance class. Therefore, the proposed technology enables obtaining compact windings for high-voltage transformers with a high thermal resistance class.

What is claimed is:

1. A method for manufacturing electrical windings comprising the steps of:

a) providing a metal or composite mandrel defining internal shape of a winding;

b) applying release agent on a surface of the mandrel for facilitating extraction off the mandrel;

c) installing an internal layer on the mandrel;

d) installing side rings on the mandrel next to the internal layer;

e) fixing an end metal wire in one of the side rings;

f) fixing an impregnated insulation tape or a few impregnated insulation tapes on the metal wire or on the mandrel and a feeding system with polymer or varnish used for impregnation;

g) optionally fixing an impregnated glass fiber roving or a few impregnated glass fiber rovings on the metal wire or on the mandrel and a pretension system with the same impregnating polymer as in the previous step f);

h) pouring a thermally conducting compound consisting of a mixture of a polymer the same as in the previous steps f) and g) with electrically non-conducting powder and/or chopped glass fiber on the horizontally turning mandrel;

i) making a cylindrical multilayer winding with a metal wire by turning the mandrel and performing horizontal displacements with the feeding system of the metal wire;

j) making an interlayer and/or side insulation by performing horizontal displacements with feeding systems of said insulation tapes;

k) optionally providing reinforcement layers wound by the impregnated glass fiber rovings by performing horizontal displacements with feeding systems of said glass rovings;

l) pouring said thermally conducting compound on the horizontally turning mandrel if the thermally conducting compound on the mandrel has been consumed during winding;

m) curing the obtained winding by performing a curing cycle determined by the exact type of the polymer used in the winding with the mandrel turning horizontally; and n) extracting of the winding from the mandrel.

2. The method according to claim 1, wherein the mandrel has a slight taper in a direction of extraction.

3. The method according to claim 1, wherein:

a) the internal layer is made by pouring a thermally conducting compound consisting of a mixture of a polymer or vanish with electrically non-conducting powder and/or chopped glass fiber on the rotating mandrel with incomplete curing of said compound; or b) the internal layer is made by winding with glass fiber impregnated with polymer or varnish and curing upon completion of the winding; or c) the internal layer is provided by premade glass-fiber bandage manufactured on the mandrel; or d) the internal layer is provided by winding a net with axial spacers.

4. The method according to claim 1, wherein:

a) the side rings are cut of a glass-fiber composite bandage previously manufactured on the mandrel; or b) the side rings are made of metal;

c) a slot in the one of the side rings is used for fixing the end wire; and d) rings with turning pins are installed on the mandrel before installing the side rings and the end wire is fixed between rows of said pins.

5. The method according to claim 1, wherein a distance between the side rings defines an axial length of the winding and an outer surface of said rings corresponds to an outer surface of the winding.

6. The method according to claim 1, wherein:

a) the interlayer insulation is wound in accordance with voltage gradient between layers, that is for each new winding layer, the interlayer insulation wound on a top of this winding layer should be thicker in the beginning of this winding layer and thinner at the end of the layer;

b) the interlayer and side insulation are wound simultaneously and have overlapping with each other;

c) the interlayer insulation is provided by winding a net with axial spacers or installing unconnected axial spacers; and d) the interlayer insulation has constant or varying thickness.

7. The method according to claim 1 where the winding with metal wire is performed with a specified pretension and this pretension is maintained through the whole winding process.

8. The method according to claim 1, wherein cylindrical reinforcement layers with winding angle in the range from 45° to 90° with respect to an axis of rotation of the mandrel as well as axial reinforcement layers with winding angle in the range from 0° to 45° with respect to the axis of rotation of the mandrel are wound.

9. The method according to claim 1, wherein a previously manufactured composite bandage with or without internal axial channels is slid over the winding upon completion of a section of the metal wire.

10. The method according to claim 1, wherein a few windings are produced on the same mandrel next to each other and/or around each other.

11. The method according to claim 1, wherein curing is performed with a temperature of the mandrel larger compared to the average temperature of the winding.

12. The method according to claim 1, wherein:

a) the metal wire of the cylindrical multilayer winding is a copper or an aluminum wire of a round or a rectangular cross section with enamel or polyimide turn insulation;

b) a fiberglass bandage with a last layers from carbon fiber, increasing mechanical strength of the winding and creating compression of the insulation in the whole volume, is wound on the winding; and c) an interlayer and butt-end insulation are made from fiberglass and are represent a solid homogeneous part in the whole volume of the winding as a result of a continuous winding process and subsequent compression of the winding by means of a bandage.

13. A method for manufacturing oil-immersed electrical windings comprising the steps of:

a) providing a metal or composite mandrel defining an internal support for a winding;
b) installing an internal layer or a previously manufactured internal cylinder;
c) installing side rings;
d) fixing an end metal wire;
e) fixing an impregnated insulation tape or a few impregnated insulation tapes, each tape having a separate impregnation and feeding system with polymer or varnish used for impregnation;
f) optionally a fixing impregnated glass fiber roving or a few impregnated glass fiber rovings, each roving having a separate impregnation and pretension system with the same impregnating polymer as in the previous step e);
g) making a cylindrical multilayer winding with a metal wire by turning the mandrel and performing horizontal displacements with feeding system of the metal wire;
h) making an interlayer and/or side insulation by performing horizontal displacements with feeding systems of said insulation tapes;
i) optionally providing reinforcement layers wound by impregnated glass fiber rovings by performing horizontal displacements with feeding systems of said glass rovings;
j) curing the obtained winding by performing a curing cycle determined by the exact type of the polymer used in the winding with the mandrel turning horizontally; and
k) extracting of the winding from the mandrel.

14. The method according to claim 13, wherein:

a) metal wires have a round or a rectangle or any other cross section;
b) curing of the winding is performed with an average temperature of the mandrel larger compared to the average temperature of the winding;
c) metal wire actually comprises a few metal wires being wound simultaneously; and
d) metal wire is wound with pretension ranging from 0.1 MPa to 500 MPa and this pretension is maintained during the winding.

15. The method according to claim 13, wherein the metal wire is wound with a variable space between turns in order to achieve cooling channels.

16. The method according to claim 13, wherein a slot in the one of the side rings is used for fixing the end wire.

17. The method according to claim 13, wherein rings with turning pins are installed on the mandrel before installing the side rings and the end wire is fixed between rows of said pins.

18. The method according to claim 13, wherein:

a) the interlayer insulation is wound in accordance with voltage gradient between layers;
b) the interlayer and side insulation are wound simultaneously and have overlapping with each other;
c) the interlayer insulation is provided by winding a net with axial spacers or installing unconnected axial spacers; and
d) the interlayer insulation has constant or varying thickness.

19. The method according to claim 13, wherein at least one previously manufactured composite bandage with or without internal axial channels is slid over the winding upon completion of a section of metal wire.

20. The method according to claim 13, wherein a few windings are produced on the same mandrel next to each other and/or around each other.

21. The method according to claim 13, wherein:

a) the metal wire is a copper or an aluminum wire of a round or a rectangular cross section with paper wire insulation;
b) an insulation from a tape of cable paper, impregnated with transformer oil, is wound on the whole axial length of a support cylinder of the winding;
c) the interlayer insulation from a tape of cable paper, impregnated with transformer oil, is wound on an external layer of wires on the whole axial length of the winding;
d) the interlayer insulation from a dry tape of cable paper is wound on an external insulation layer from a tape of cable paper, impregnated with transformer oil, on the whole axial length of the winding;
e) a fiberglass bandage with a last layers from carbon fiber, increasing mechanical strength of the winding and creating compression of the insulation in the whole volume, is wound on the winding;
f) an interlayer and butt-end insulation are made from a tape of cable paper impregnated with transformer oil and are represent a homogeneous part with insulation in accordance with items b), c) and d) in the whole volume of the winding as a result of the continuous manufacturing process of the winding and as a result of compression of the winding by means of a bandage.

22. A method for manufacturing electrical windings comprising the steps of:

a) providing a metal mandrel defining an internal shape of a winding;
b) applying a high temperature release agent on a surface of the mandrel for facilitating extraction off the mandrel;
c) installing a set of spacers on the mandrel;
d) installing side rings on the mandrel;
e) fixing an end metal wire in one of the side rings;
f) pouring liquid lead glass on the mandrel;
g) performing winding with metal wire with a specified axial spacing;
h) installing the following layer of spacers upon completion of a winding layer with said spacers optionally containing axial cooling channels;
i) extracting of the winding from the mandrel; and
j) winding a layer of glass fiber reinforcement with pretension in order to create specified prestress in the volume of the winding.

23. The method according to claim 22, wherein the winding with metal wire is preformed dry and the volume of the winding is filled with liquid lead glass after the winding process is completed.

24. The method according to claim 22, wherein the spacers are made of high temperature glass.

25. A method for manufacturing electrical windings comprising the steps of:

a) providing a glass-fiber reinforced thermoplastic cylinder defining internal shape of the winding;
b) installing thermoplastic side rings on the thermoplastic cylinder;
c) fixing an end metal wire with thermoplastic insulation in the one of the thermoplastic side rings;
d) performing winding of a metal wire with a thermoplastic insulation with specified pretension and with simultaneous local heating of the thermoplastic insulation;
e) fixing the second end wire upon completion of the winding process; and
f) winding a layer of glass fiber reinforcement with pretension in order to create specified prestress in the volume of the winding.

26. The method according to claim 25, wherein a polyetheretherketone (PEEK) is used as thermoplastic insulation material.

27. The method according to claim 25, wherein a cross-linked polyethylene is used as thermoplastic insulation material.

28. The method according to claim 25, wherein winding is performed in melted thermoplastic insulation material poured on the inner cylinder of winding in the beginning of the winding process.

29. The method according to claim 25, wherein a sheet of the same type of thermoplastic insulation material is placed on the winding upon completion of each winding layer.

30. The method according to claim 25, wherein consolidation of thermoplastic insulation material is achieved locally by applying local heating and providing according pressure by a set of rolls with application of radial compression in order to achieve consolidation of layers of the winding and axial compression in order to achieve consolidation either with the one of the thermoplastic side rings or with the previous turn.

31. The method according to claim 25, wherein:

a) a set of spacers either of the same type of thermoplastic material or another insulation material with higher operational temperature is placed on the winding upon completion of each winding layer;

b) winding with metal wire is carried out with a specified axial spacing; and c) upon completion of the winding the volume of the winding is filled with a thermoplastic polymer.

32. The method according to claim 25, wherein:

a) the metal wire is a copper or an aluminum wire of a round or a rectangular cross section with wire insulation from cross-linked polyethylene;

b) a fiberglass bandage with a last layers from carbon fiber, increasing mechanical strength of the winding and creating compression of the insulation in the whole volume, is wound on the winding;

c) a butt-end insulation and wire insulation from cross-linked polyethylene are represent a solid homogeneous structure as a result from compression of polyethylene in the whole volume at softening temperature either by means of utilizing pretension applied to the wire during winding or by utilizing compression provided by a set of rolls with application of radial compression in order to achieve consolidation with the previous layer of the winding and axial compression in order to achieve consolidation either with a side ring or with the previous turn or by means of compression of winding in an autoclave or in a press mold.

33. The method according to claim 25, wherein:

a) the metal wire is a copper or an aluminum wire of a round or a rectangular cross section with polyimide wire insulation;

b) a fiberglass bandage with a last layers from carbon fiber, increasing mechanical strength of the winding and creating compression of the insulation in the whole volume, is wound on the winding;

c) an interlayer and butt-end insulation are made from polyimide tapes with a gluing layer and are represent a homogeneous part in the whole volume of the winding as a result of the continuous manufacturing process of the winding and as a result of compression of the winding by means of a bandage.

* * * * *